US011725495B2

(12) United States Patent
Poulson

(10) Patent No.: US 11,725,495 B2
(45) Date of Patent: Aug. 15, 2023

(54) CROWDING AVOIDANCE APPARATUS AND METHOD

(71) Applicant: Heath Poulson, Fairview, UT (US)

(72) Inventor: Heath Poulson, Fairview, UT (US)

( * ) Notice: Subject to any disclaimer, the term of this patent is extended or adjusted under 35 U.S.C. 154(b) by 0 days.

(21) Appl. No.: 18/103,707

(22) Filed: Jan. 31, 2023

(65) Prior Publication Data

US 2023/0167730 A1 Jun. 1, 2023

Related U.S. Application Data

(62) Division of application No. 17/329,452, filed on May 25, 2021, now Pat. No. 11,585,204.

(60) Provisional application No. 63/029,887, filed on May 26, 2020.

(51) Int. Cl.

| | |
|---|---|
| ***E21B 44/02*** | (2006.01) |
| ***E21B 47/06*** | (2012.01) |
| ***E21B 47/013*** | (2012.01) |

(52) U.S. Cl.

CPC ..... *E21B 44/02* (2013.01); *E21B 47/013* (2020.05); *E21B 47/06* (2013.01)

(58) Field of Classification Search

CPC ..... E21B 47/06; E21B 47/013; E21B 44/02
See application file for complete search history.

(56) References Cited

U.S. PATENT DOCUMENTS

| | | | | | |
|---|---|---|---|---|---|
| 1,831,437 | A * | 11/1931 | Brantly | E21B 19/08 | 188/295 |
| 2,085,336 | A * | 6/1937 | Sandstone | E21D 1/06 | 175/227 |
| 3,525,404 | A * | 8/1970 | Kelly, Jr. | E21B 44/06 | 173/4 |
| 3,674,098 | A * | 7/1972 | Virgo | E21B 19/08 | 173/159 |
| 4,137,974 | A * | 2/1979 | Decker | E21B 44/02 | 173/147 |
| 4,258,796 | A * | 3/1981 | Horning | E21B 19/146 | 173/147 |
| 7,350,593 | B1 * | 4/2008 | Brookover | E21B 44/02 | 173/4 |
| 2011/0309315 | A1 * | 12/2011 | Williams | H02P 7/06 | 254/362 |
| 2021/0230944 | A1 * | 7/2021 | Woodward | E21B 10/322 | |

* cited by examiner

*Primary Examiner* — Shane Bomar
(74) *Attorney, Agent, or Firm* — Pate Nelson Hill, PLLC

(57) ABSTRACT

A crowding avoidance sub (CAS), in or above a bottom hole assembly (BHA), e.g., between drill string and BHA, sends sensor data over lines in a modified housing and flex lines accommodating and reporting relative axial motion between movable parts of a single sub, typically below a cushion, jar, or shock sub, possibly even a motor. Sensors connected to an Intellisys™ data connection system provide a data stream to a computer at the surface, and may include downhole preprocessing, but need not. The drive system of the hook feed rate is directly controlled in real time by a data station receiving, and operating based on, "travel" or "progress" information received from downhole sensors of the CAS indicating effectively instantly and electronically (rather than slower signals through drilling fluid) whenever the string progresses dangerously faster than the bit, and must be slowed or stopped.

20 Claims, 15 Drawing Sheets

CROWDING AVOIDANCE APPARATUS AND METHOD

RELATED APPLICATIONS

This application is a divisional application of co-pending U.S. patent application Ser. No. 17/329,452 filed on May 25, 2021 and titled CROWDING AVOIDANCE APPARATUS AND METHOD, which claims the benefit of U.S. Provisional Patent Application Ser. No. 63/029,877, filed May 26, 2020. The foregoing references are hereby incorporated herein by reference.

BACKGROUND

Field of the Invention

This invention relates to deep-earth drilling equipment such as bottom-hole-assemblies (BHA), and subassemblies (subs), and more particularly, to novel systems and methods for reducing damage to drill bits in the bore.

Background Art

Drilling, such as petroleum drilling, progresses at rates up to about four feet per minute in a formation being drilled. Formations are usually predicted based on geologic analysis of seismic data, previous drilling sites, core samples, and so forth. Geology is not a perfect science, and an underground formations can vary within general features. For example, underground faults may alter a specific constitution within a formation, and other vagaries of nature may conspire to precipitously alter materials at the cutting face of a bit.

A drill string may have a dead weight of a million pounds suspended from the top side support. A tower or derrick, from which is suspended the "hook," supports the "drill string." Meanwhile, the bottom hole assembly (BHA) is typically the only weight actually applied to the bit. Thus, the drill string is suspended from the hook in tension, while the bottom hole assembly is stacked on top of the bit in compression. This means that a location exists at which the transition from the tension of the string to the compression of the bottom hole assembly provide a zero load point. This last concept is somewhat hypothetical, as such a location may change rapidly with the instantaneous motions representing advance and delay of cutting the work face of a formation under the operation of the bit.

Meanwhile, data logged is typically only of historical value. That is, between the communication mechanisms such as sonic transmission of data through the drilling fluid to the inability to provide power or data connections between the drill string and the data stations at the surface, information useful in actually managing the feed rate of the hook lowering the drill string into the bore is actually hard to come by.

One common result of a general inability to detect in real time crowding or crashing of the drill bit is that drill bits may fail upon encountering excessively hard deposits. Bits may slow down their rate of penetration in extending the bore. Reducing the rate of progress or penetration by the bit results in the string continuing to descend on a BHA with a stalled motor or bit, overloading the bit. Whereas a BHA may weigh about sixty five thousand pounds, or just over thirty two tons, the drill string typically has a weight of five hundred tons or a million pounds of dead weight.

When a drill string continues to feed at the rate set by operator controls, while a bit slows down its rate of penetration, the result will typically be "crowding" of the bit. Loading the BHA with string weight may result in stalling the down hole "mud motor" but ultimately may force the bit into the cutting face of the formation with such force as to break the bit, damage it, or lodge it in the cutting face.

To replace a damaged, broken, or otherwise inoperable bit, motor, or the like requires a "trip" of the drill string. Tripping a drill string means lifting the drill string by the hook, removing each section of drill tubing, as the entire string and bottom hole assembly are removed. Then, repairs and replacements are done as needed. Thereafter, the drill string may be reassembled and reinserted into the formation bore to continue drilling.

Such a trip will typically require days of nonproductive time for a rig. The financial cost of such a trip may be in excess of a million dollars. Of course, the actual cost of lost time, expense, and difficulty of a trip may depend upon the total depth of the bore.

It would be an advance in the art to be able to detect conditions correlating or indicating potential crowding of a bit. It would be a further advance in the art to be able to use that information in real time to control the feed rate of a drive system controlling descent of the hook and string. Thus, it would ultimately be a substantial advance in the art to be able to control the feed drive for a drill string sufficiently quickly to respond to some indication of crowding of the bit. It would be an advance to prevent crashing or damage to the bit, motor, or both by immediately send a command reducing the feed rate, thereby unloading the bottom hole assembly from supporting any portion of the weight of the drill string above it.

BRIEF SUMMARY OF THE INVENTION

In view of the foregoing, in accordance with the invention as embodied and broadly described herein, a method and apparatus are disclosed in one embodiment of the present invention as including a crash avoidance system or crowding avoidance sub (CAS), whether a dedicated or adapted subassembly (sub) in a bottom hole assembly (BHA). It may, for example, typically be located somewhere above the motor and bit in the BHA, or between a suspended drill string and the BHA. In certain circumstances, sensors may be located below the top end of the motor, but the complexities multiply.

With data lines in a modified housing and flex lines for relative, linear, axial motion between movable parts of a single sub, sensors are contemplated to put a CAS ahead of a cushion, jar, or shock sub, even a motor. However, sensors are best connected to an Intellisys™ data connection system providing a data stream to a computer on the surface. Certain preprocessing may be done down hole, but need not be. Control of the drive system of the hook feed rate is directly controlled in real time by a data station receiving, and operating based on, certain information received from the down hole sensors of the CAS.

In certain embodiments, an apparatus may include a drilling rig comprising a suspended drill string defining an axial direction and extending into a formation in the earth. A lift system for controlling descent of the suspended drill string connects to a bottom hole assembly (BHA) driving a bit into the formation, under its own (the BHA) weight. Thus the weight on the bit (usually shortened to "weight on bit" and abbreviated WOB) does not include that of the suspended drill string. The drill string may include the BHA, based on context, but when stated as "suspended drill string" it affirmatively excludes the BHA.

This is because the suspended drill string is in tension, while the BHA is in compression, with a very nervous and somewhat migrational point at which the overall string must transition from tension to compression. A crowding avoidance sub (CAS) comprising a base and a slide, the two being capable of relative axial motion with respect to one another, may typically have the slide fixed with respect to the string and electronically connected to pass data in an electronic format up the string toward the surface.

In the CAS, a sensor operably connects in the slide to send data representing a parameter reflecting the relative axial motion. A computer is operably connected between the sensor and the lift system and programmed to reduce the descent of the suspended drill string immediately in response to the data from the sensor, in real time. The invention is not about logging data, but about avoiding crowding and crashing of bits. For example, a typical million pounds of a suspended drill string can overload a BHA, which typically amounts to only about 65,000 pounds WOB.

Thus, the data, whatever the parameter measured by the sensor, warns that the suspended drill string is moving closer to the bit. The sensor is positioned and capable of detecting at least one parameter. Parameters detected may include one or more of acceleration, motion, velocity, position, pressure, frequency, and strain.

One useful parameter during testing was a frequency of vibration. It actually may be in an audible range, but proceeding from too far away to be heard. With automatic accumulation of signals over a period of time, the parameter may be an integral with respect to time of the parameter detected, or the signal output, by a sensor. The sensor is a physical device providing an electrical signal based on variation of the parameter. Thus, as the parameter varies rapidly across some mean or average value, frequency may be detected from almost any type of sensor Likewise, integration can by done as a simple Riemann sum as understood in basic mathematics.

When the parameter is a frequency of vibration within the range of human hearing, it rises whenever the bit strikes a harder material than it has previously been progressing through. Thus, that sound change indicates the relative axial motion in the CAS is occurring, any reduction of length of two members permitting relative motion corresponds to a reduction of axial progression of the bit with respect to the suspended string.

A method may comprise providing suitable hardware, selecting it, or adapting a system to fit in it. For example, a drilling rig comprising a suspended drill string defines an axial direction into a surface of a formation. A lift controls descent of the suspended drill string. A bottom hole assembly (BHA) terminates at a bit defining (drilling into) a cutting face in the formation. A crowding avoidance sub (CAS) comprises a base and a slide, capable of relative axial motion with respect to one another. The slide includes or receives a sensor operably connected to pass data in an electronic format up the string toward the surface.

In operation, the method relies on descending the BHA, equipped with the CAS, downward into the formation at a rate of descent of the bit. Behind the BHA, descends the suspended drill string following the BHA at the rate of descent set by the bit, and controlled by the lift controlling computer. When responding to an increased hardness in the formation, the bit reduces its rate of descent.

Detecting, by the sensor, a parameter corresponding to that reducing of the rate of descent, the sensor sends to the computer at the surface a signal reflecting the parameter. Accordingly, controlling, by the computer, the descent of the suspended drill string, based on the signal avoids crowding the bit and avoids crashing it. A damaged bit may otherwise require repairs or replacement, at the cost of a million dollars or more due to non-productive work and operational time lost while the string is "tripped" out and back down, requiring complete disassembly and reassembly.

A method in real time, wherein the parameter of interest represents the relative axial motion, may be detectable directly or through some other parameter. A physical condition detected by a sensor causes the signal, configured as data reflecting a property, parameter, condition, etc. corresponding to the suspended drill string moving closer to the slowing bit. The sensor is positioned and capable of detecting at least one of an acceleration, motion, velocity, position, pressure, frequency, and strain. All may be sensed by appropriate connections and sensors.

When the sensor detects a frequency of vibration, it may do so from one of any of several types of sensors, just due to the rapid change in values sensed due to the bouncing and jarring natural to drilling a formation. One or more parameters may be an integral with respect to time of a signal output by the sensor. For example, a physical device providing an electrical signal based on variation of the parameter may detect any of the parameters listed hereinabove.

One ubiquitous parameter is a frequency. It has been found that certain frequencies represent or reflect vibrations capable of carrying as sounds within the range of human hearing. These often rise in frequency when the relative axial motion corresponds to a reduction of axial progression of the bit with respect to the suspended string. The bit is "screaming" as it slows against a harder portion of a formation, by raising the frequency of its cutting and jarring, corresponding to smaller progress and thus faster vibration in less distance covered by each diamond cutter with each "bite" it takes at the formation.

A method may begin with providing a drilling rig comprising a drill string defining an axial direction for drilling a formation in the earth, a lift at a surface of the formation and suspending the drill string, a bottom hole assembly (BHA) driving a bit cutting into the formation, a crowding avoidance sub (CAS) comprising a base, slide, and sensor, the base and slide capable of relative axial motion with respect to one another, and the sensor operably connected to detect a condition in the CAS and to output data, reflecting the condition, electronically up the string to a computer at the surface.

The method may then include drilling, by the bit, into the formation at a first rate of descent; controlling the lift to effect descent of the drill string at the first rate of descent, following the BHA; sensing, by the sensor, the condition, reflecting a reduction to a second rate of descent, less than the first rate of descent, by the bit; and consequently commanding, by the computer in real time, the lift to reduce progress of the drill string to avoid crowding the bit by the drill string.

This method may rely on a parameter that reflects the relative axial motion. For example, it may be based on at least one of an acceleration, motion, velocity, position, pressure, frequency, and strain. The sensor may be positioned to detect a frequency of vibration, but the concern is any signal configured as data reflecting the suspended drill string moving closer to the bit. That is a crash in the offing. Early or even instant detection with a prompt response to slow or stop descent of the suspended string will be needed to avoid crowding (partial loading) or crashing (damaging the bit, motor, or both by overloading above the WOB due to the suspended string loading.

A parameter as an integral with respect to time of a signal output by the sensor, may be readily obtained. Since the sensor is a physical device providing an electrical signal based on variation of the parameter measured over time, integration may be a Riemann sum, adding the signal value multiplied by its time of duration. If the parameter is a frequency of vibration within the range of human hearing, it may be represented in a data station as a sound in visual and audio replication. Since the relative axial motion corresponds to a reduction of axial progression of the bit with respect to the suspended string, sensing, by the sensor may be an output voltage, simple detection of proximity of the slide along the base at certain locations, or the output of accelerometers or gyros of suitable type, such as ring laser gyros. These may output voltages preprocessed down hole immediately based on the time of duration of the signal at any value, which will typically change rapidly. Pre-processing the parameter may effectuate sending an emergency trigger to the computer top side (at the surface) reflecting a need to stop the drill string descending as soon as possible.

BRIEF DESCRIPTION OF THE DRAWINGS

The foregoing features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

DETAILED DESCRIPTION OF THE PREFERRED EMBODIMENTS

Figure 1:
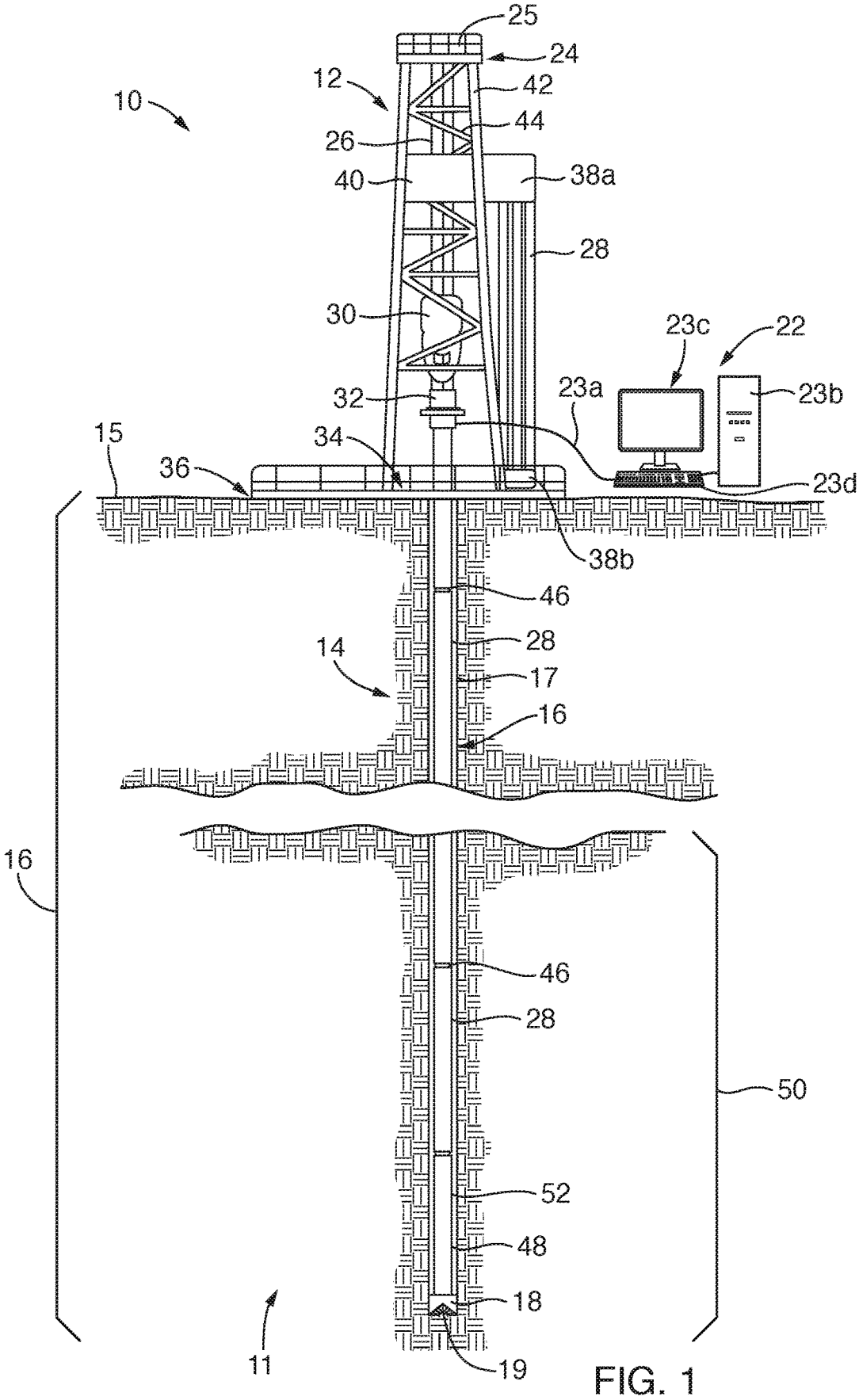
FIG. 1 is a schematic diagram of a drilling system with a rig, including a tower or derrick above a formation, being monitored and controlled by a data station.

It will be readily understood that the components of the present invention, as generally described and illustrated in the drawings herein, could be arranged and designed in a wide variety of different configurations. Thus, the following more detailed description of the embodiments of the system and method of the present invention, as represented in the drawings, is not intended to limit the scope of the invention, as claimed, but is merely representative of various embodiments of systems and methods in accordance with the invention. The illustrated embodiments will be best understood by reference to the drawings, wherein like parts are designated by like numerals throughout.

Figure 2:
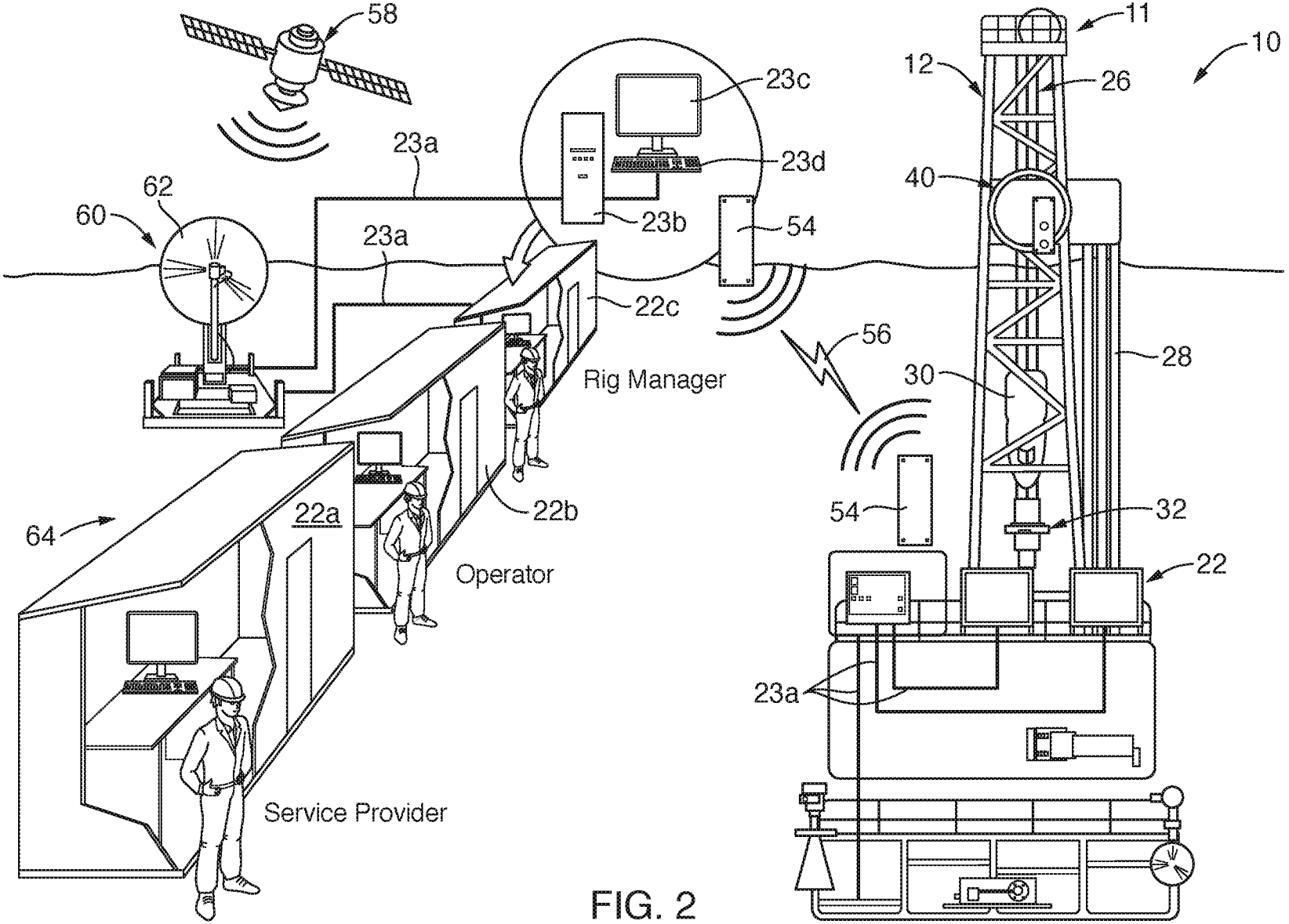
FIG. 2 is a schematic diagram of addition details for a rig and data system in accordance with the invention.

Referring to FIGS. 1 and 2, while referring generally to FIGS. 1 through 13, a system 10 in accordance with the invention is focused on the control of a rig 11 constituted by a tower 12 or derrick 12 above a formation 14 to be drilled. Typically, a string 16 or drill string 16 is lowered by the rig 11 to drill a bore 17 down through a formation 14. A bit 18 at the bottom end of a string 16 actually works against the cutting face 19 at the bottom of the bore 17. Herein, a trailing letter after a reference numeral is merely a specific instance of that reference numeral.

It is proper to speak of the drill string 16 being everything from the surface of the formation 14 down to the cutting face 19, including the bit 18. Nevertheless, one may also speak of the drill string 16 being that portion of the drill string 16 that is suspended in tension by the derrick 12, not including the bottom hole assembly 20 (BHA 20). The BHA 20 actually puts weight on the bit 18 (WOB). However, hereinafter, the use of the term drill string 16 should be apparent from the context of its use. Thus, at times, the drill string 16 includes everything in the bore 17 down to the cutting face 19 while other times it will mean only that suspended portion 130 (see FIG. 7) of the drill string 16 above the BHA 20. The BHA 20 is composed of components all in compression and applying load to the bit 18 from above.

In the illustrated embodiments, a data station 22 may be present to control operation of the rig 11. Specifically, the drill string 16 may be rotated in order to rotate the bit 18, to cut the bore 17 at the cutting face 19. However, modern drilling techniques more often rely on rotating the bit 18 with respect to a string 16 that does not rotate, but simply extends or translates downward through the bore 17 to follow the bit 18 in its progress.

In a typical data station 22, or control station 22, various operators may have individual stations 22. For example, a service provider may have a data station 22*a* at which an operator observes and controls. Meanwhile, an operator of the site may have a data station 22*b* for similar functions. Meanwhile, a rig manager may have a rig manager data station 22*c*. Meanwhile, individual data stations 22 may be provided with various constituent components 23. For example, a data line 23*a* may connect any component 23 to another 23. A computer 23*b* may process inputs, commands, controls, and conduct various processing for analyzing or operating on data.

Meanwhile, associated with a computer 23*b* may be a display 23*c* for communicating image information, charts, process data, graphs, schematic diagrams, and the like as needed to interpret information and the status of various components in the rig 11. Likewise, an input device 23*d* or multiple input devices 23*d* may permit a user to provide inputs to computer programs, request information, instruct the computer 23*b* to conduct certain analyses or to issue certain commands and the like.

In the mechanical system, a deck 24 or upper deck 24 may support a hoist 26. The hoist 26 is responsible to connect to the string 16, and initiates the top of the string 16, where it connects to individual tubing 28 or drill tubing 28. The component responsible to make that connection between the hoist 26 and the tubing 28 is called a hook 30, which need not be configured as a literal hook 30, but is responsible to support the weight of the string 16. Meanwhile, the hook 30 may be raised and lowered by the hoist 26 with respect to the tower 12.

Typically, the first tubing 28 to be connected to the hook 30 may include a swivel 32 or swivel sub 32. A swivel 32 may include devices to interface between data collection lines in the string 16 and the data lines 23*a* associated with a data station 22 or a control station 22. A turntable 34 may selectively engage the tubing 28 of the string 16 for several reasons.

For example, during any portion of a drilling operation during which the string 16, itself, is to be rotated, the turn table 34 in the lower deck 36 will do so. Meanwhile, the turn table 34 may also have a "catcher" (not shown) in order to secure the string 16 against falling, while additional lengths of tubing 28 are added between the swivel 32 connected to the hook 30 and the remainder of the string 16 suspended therebelow. After all, drill tubing is not typically continuous, but rather is assembled in segments. Each tubing segment 28 being connected is threaded in its turn by its lowest pin 72 into the top box 74 in the string 16 below. The swivel 32 and hook 30 above it thread into the top-most tube 28 in the string 16.

Accordingly, a holder 38, typically including a top holder 38*a* and a bottom holder 38*b* may secure in place lengths of tubing 28 in close proximity to the deck 36. They are later moved by a loader 40 to a threading position over the string 16. The loader 40 also moves a length of tubing 28 between the hook 30 and swivel 32 when removed from the string 16, upon removal therefrom. The string 16 will be located near the deck 36 awaiting receipt of each length of tubing 28 in order to continue passing down the bore 17.

Typically, a tower 12 may include generally vertical pillars 42 cross braced by struts 44 therebetween. Meanwhile, each length of tubing 28 is joined to another at a joint 46 threadedly connecting them thereto.

Ultimately, near the bottom of the string 16, a motor 48 will typically be responsible to rotate the bit 18 with respect to the string 16. The bit 18 is the bottom-most member 18 of the bottom hole assembly 50 (BHA 50). In operation, the motor 48 receives a drilling fluid 51 comprising primarily water, with certain additives, each added for its own specific purpose, that will pass down through each of the lengths of tubing 28 of the string 16, ultimately exiting out through the bit 18 itself. In passing through the motor 48 the drilling fluid 51 in the tubing 28 provides a rotary motion to a rotor inside a stator, fixed to an outer wall of the motor 48. The rotor connects to rotate the bit 18.

Meanwhile, various subassemblies 52 or subs 52 may perform other specific duties within the BHA 50. More will be said about those various subs 52 hereinbelow as appropriate.

Referring to FIG. 2, while continuing to refer generally to FIGS. 1 through 13, the data stations 22, and particularly any data stations 22 associated with the rig 11 itself, may have radios for intercommunication across longer distances. A drilling site is expansive, and may necessitate radio links 56 between radios 54 associated with data stations 22 at the rig 11, at the control stations 22*a*, 22*b*, 22*c*, and elsewhere.

Likewise, a satellite 58 may connect a communication station 60 and other remote sites, such as a company headquarters, a data collection site, or the like. In fact, any particular data station 22 may be located where it is physically appropriate, in view of any need for access, monitoring, viewing, inputting, or the like by a device or a human. Typically, an antenna 62 at a communication station 60 may receive and transmit signals exchanged with a satellite 58 linked to the internet, or a remote location by a dedicated or shared link suitable for the task.

An operations center 64 may involve one or more of the data stations 22*a*, 22*b*, 22*c* in order to receive, process, apply, and feed back to the rig 11 commands based on data received from the BHA 50.

Referring to FIGS. 3A through 3D, a crash avoidance sub 70 or CAS 70 will typically connect into the BHA 50 with a conventional pin 72 at a lower end thereof, and a box 74 configured to receive a pin 72 from any element thereabove. A pin 72 and box 74 have a thread system that is substantially universal in the drilling industry. Although various connections between components within any particular sub 52 may be proprietary or unique as required to accomplish any specific function, the standard pin 72 and box 74 are required to fit into the string 16. Thus, elements 76, whether tubing 28 or otherwise may connect into the box 74 of the CAS 70.

In the illustrated embodiment, a cushion sub may be adapted to operate as a CAS 70. For example, in the illustrated embodiment, a slide 78 translates (moves in a straight line in three dimensional space) with respect to a body 80. The body 80 in this case may be made up of a base 81*a* and a shell 81*b*. Essential to operation of a bit 18 in a bore 17 is the ability to rotate circumferentially in a rotary motion with respect to the string 16.

Again, a string 16 itself may be rotated with respect to the earth in order to rotate a bit 18. However, modern drilling techniques typically fix the string 16 with respect to rotation and translate it vertically down (feed the string 16 axially into the bore 17) following the bit 18. Thus, the bit 18 depends upon the reactionary force (resistance) of the string 16 not rotating. The rotor of the motor 48 is responsible to rotate the bit 18 with respect to the string 16 and the housing and stator fixed to the BHA 20.

The illustrated embodiment, a spline 82, or interleaved splines on the slide 78 and the body 80 are responsible to assure that no relative rotation exists between the slide 78 and the body 80. Thus, lands 83*a*, on the slide 78 constitute inner lands 83*a*. Likewise, grooves 83*b* represent grooves 83*b* between the lands 83*a*. That is, inner lands 83*a* extend from the slide 78, separated by inner grooves 83*b*.

Likewise, interleaving with the inner lands 83*a* and inner grooves 83*b* are the outer lands 83*c* and outer grooves 83*d* of the body 80. In the illustrated embodiment, connections are simplified by not passing a data connection between the moving elements 78, 80. By simplifying the connections to only pass between the slide 78 fixed to the element 76 or member 76 next thereabove, data can be passed up the string 16 without having to pass across any moving joint until arriving at the swivel 32.

The body 80 includes both an extension 86 fitting the inner diameter of a leg 88 (actually a cylinder 88) descending as part of the slide 78. The base 81*a* may be a single and solid piece with the shell 81*b*. However, assembly is always an issue, and the necessity of interferences in order to limit motion will require that certain components be assembled from certain directions, without interference. Thus, the base 81*a* may basically secure by threading, bolting, welding, and typically by some combination thereof to the shell 81*b*.

By the same token, the extension 86 is secured, such as by bolting, welding, or some other assembly or fastening mechanism to seal along the inside of the leg 88 of the slide 78. The necessity for the leg 88 and the extension 86 is to provide for both engagement between all the splines 82 and axially (along the axial direction of the string 16) movement of the splines 82. Particularly, this includes movement of the lands 83*a*, 83*c* axially with respect to one another.

Cavities 84*a*, 84*b* exist between the slide 78 and the body 80 in order to receive the extension 86 leg 88, and the slide 78 within the body 80. For example, the splines 82 must move relative to each other whenever the slide 78 proceeds up or down with respect to the body 80. Meanwhile, being filled with liquid, the cavities 84*a*, 84*b* should not be sealed, and are nearly impossible to seal as to the splines 82. Thus, clearance gaps and so forth permit movement of liquid between the cavities 83*a*, 83*b* and into the cavity 97 of the accumulator 96.

Meanwhile, the splines 82 permit movement of fluid back and forth from the lower cavity 84*b* into the upper cavity 84*a*, from which the contained fluid may then pass into the cavity 96 of the accumulator 97 by way of a conduit 98. One will note that the relative diameters and lengths of the cavities 84*a*, 84*b* as compared to the cavity 97 are such that the cavity 97 can receive the content of the cavities 83*a*, 83*b*.

Lines 90 or paths 90 for data, and specifically signals from sensors 100 may be formed by grooving, drilling, machining, or otherwise making recesses 104 in surfaces, or by building up spaces or conduits 104 (see FIG. 4H) to carry the line 90 within the slide 78 and other subs 52 or tubing 28 in the string 16. As described by the Intellisys™ system of U.S. Pat. Nos. 7,224,288 and 6,717,501 (Hall '288 and Hall '501) incorporated by reference hereinabove. Contacts 92 between the pin 72 and box 74 of adjacent tubing 28 and subs 52 provide interconnection between the lines 90 passing up through the string 16.

Various seals 94 are required, and sealing surfaces 95 against which those seals 94 will secure and sometimes move. Thus, in the illustrated embodiment, the accumulator 96 or compression chamber 96 may connect securely to the cavities 84*a*, 84*b*. One will note that the seals 94 operating against the sealing surfaces 95 seal cavities 84*a*, 84*b*, 97 to one another. They close each other except as to one another.

Meanwhile, more robust seals 94 may be positioned between the body 80 and the slide 78 where drilling fluids 51 may pass. Thus, between the extension 86 and the leg 88 must be seals 94 that will sweep with minimal wear in the presence of drilling fluid 51. Similarly, seals between the upper ends of the shell 81*b* and the sealing surface 95 of the slide 78 must also tolerate the presence of drilling fluid 51 passing upward between the bore 17 and the CAS 70 as it returns to the surface carrying cuttings from the cutting face 19.

Various lines 98 or connections 98 are responsible to pass liquid from the cavities 84*a*, 84*b* into the cavity 97 of the accumulator 96. By the same token, such lines 98 or ports 98 may include such curvature, extensions, bends, or the like in order to providing siphoning of liquids or pressurized flow from the cavity 97 back into the cavities 84*a*, 84*b* upon extension of the slide 78 upward out of the body 80. In certain embodiments (see FIGS. 3C, 3D), it may also be possible to rely on internal cavities 84*a*, 84*b* exposed to drilling fluid 51 within the string 16, and within the CAS 70 separated against flow and pressure communication by the shell 81*b*. Against the fluid flow of drilling fluid 51 between the bore 17 and the CAS 70.

Sensors 100 may be positioned at suitable locations for taking measurements desired within the CAS 70. For example, a sensor 100*a* may be a displacement sensor 100*a*, such as a proximity sensor 100*a*. Similarly, a pressure sensor 100*b* may sense the string (drilling fluid 51) pressure inside the string 16 and inside the CAS 70, as distinguished from a pressure between the CAS 70 and the bore 17. Similarly, a pressure sensor 100*c* may detect pressure in the CAS tool 70, that is, within the cavities 84*a*, 84*b*, 97.

Meanwhile, an acceleration sensor 100*d* may be constituted by an accelerometer 100*d*, gyroscopic sensor 100*d*, both, or the like. As a practical matter, solid-state, ring-laser gyros 100*d* are often used as accelerometers 100*d*, reporting signals indicating rotation about axes and translation along axes. Thus, by any of the available modes, sensors 100*d* are responsible to detect rotation, linear acceleration, or both. For example, inertial navigation is dependent upon sophisticated, expensive, complex, and exceedingly large, gyroscopic systems. In contrast, modern technology has produced sensors 100*d* considerably smaller, in a solid state, and electronic in their outputs.

Strain gauges 100*e* are typically arranged in a rosette formation in which the principal angles of direct stress (tension, compression) as well as the associated shear stress may all be tested and reported from a single location. Again, books are written about selecting, applying, and reading strain gauges 100*e*. All of that need not be repeated here. Nevertheless, it suffices to state that strain gauges 100*e* may be installed in the CAS 70 in order to detect strain (units of length of stretch per total or unit length) as a reflection directly of stress (force per unit area). Thus, according to engineering principles stress is directly proportional to strain, by a constant called the modulus of elasticity. The modulus of elasticity is a known number for structural materials, especially steels and the like.

Frequency sensors 100*f* may include any or all of the foregoing sensors 100. For example, a frequency of a motion may be detected by every reversal of signal value from any sensor 100. Thus, accelerometers 100*d* may be used to detect a frequency of alternating motion. However, all of the sensors 100 may be relied upon to contribute inputs to a determination of frequency. Frequency may be interpreted as oscillations or vibration, characterized by sound in many instances.

Temperature is a background parameter that may affect certain properties of materials and components within a CAS 70. Accordingly, thermocouples 100*g* may be installed. They are small, simple, and quite robust. Accordingly, thermocouples 100*g* may be installed to detect and report temperatures at suitable locations. Meanwhile, channels 100*h* may be provided in which to run lines 23 of any suitable type from the sensors 100.

Figure 3A:
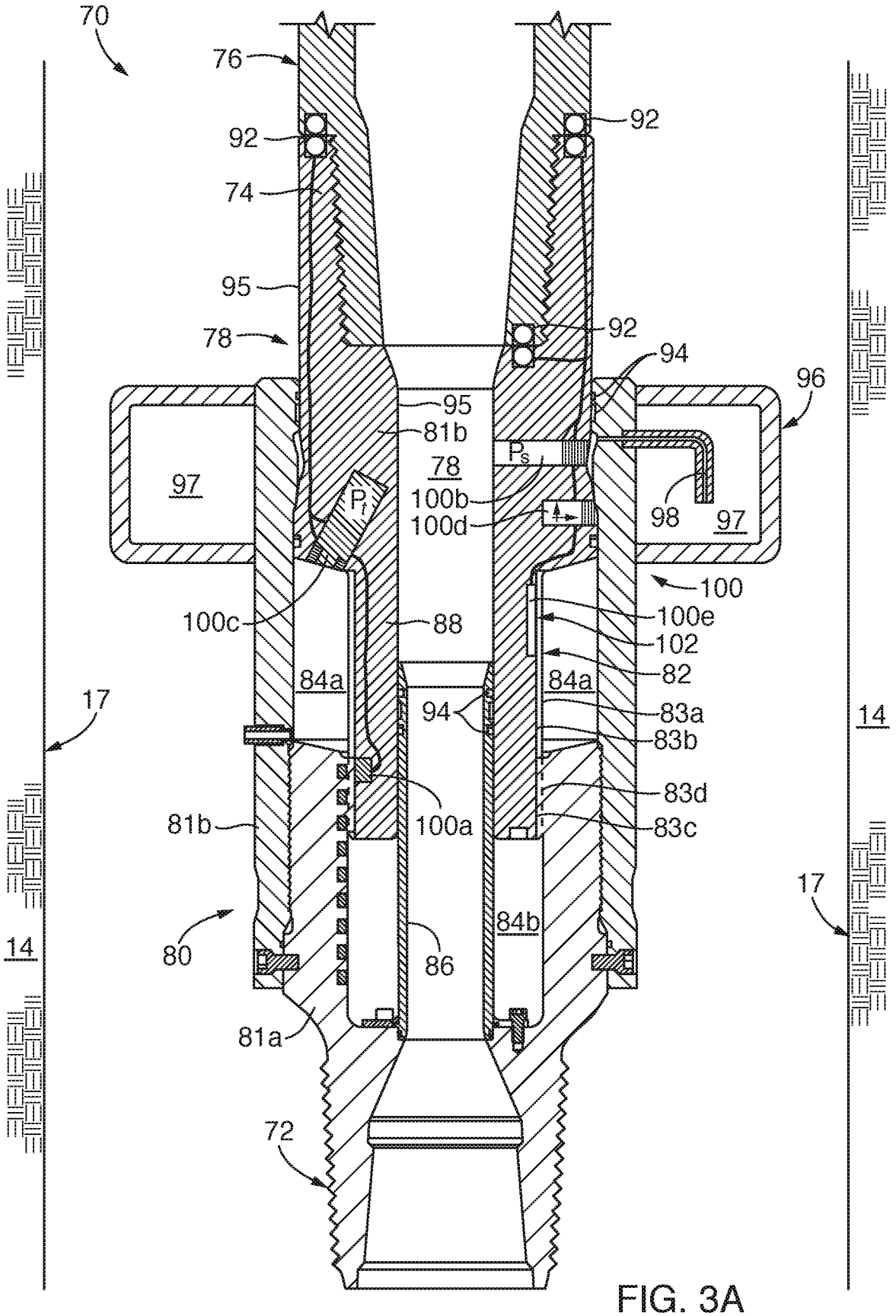
FIG. 3A is a side, elevation, cross-sectional view of one embodiment of a crash avoidance sub in accordance with the invention in an extended position.
Figure 3B:
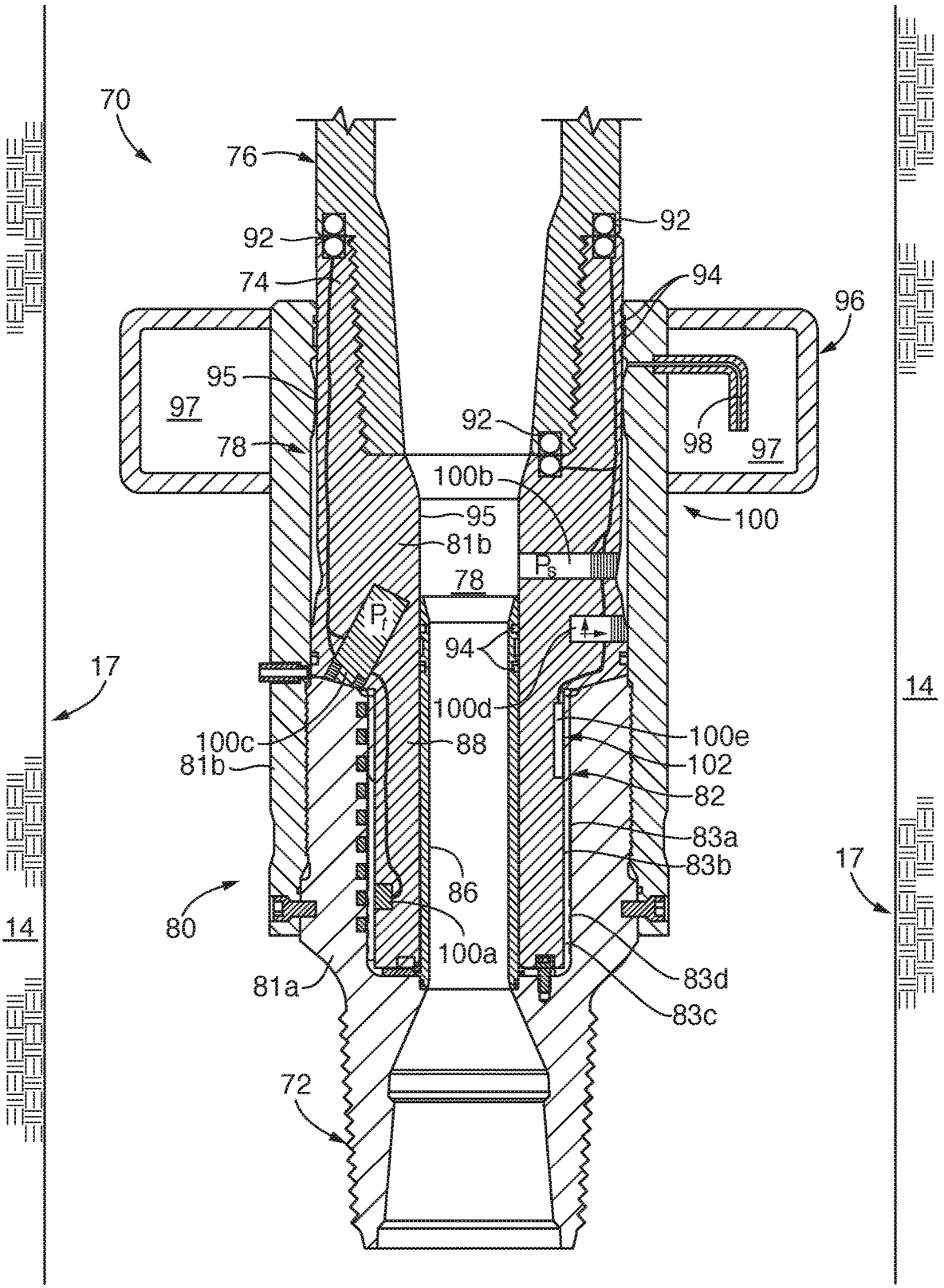
FIG. 3B is a side, elevation, cross-sectional view in a closed configuration or collapsed condition.
Figure 3C:
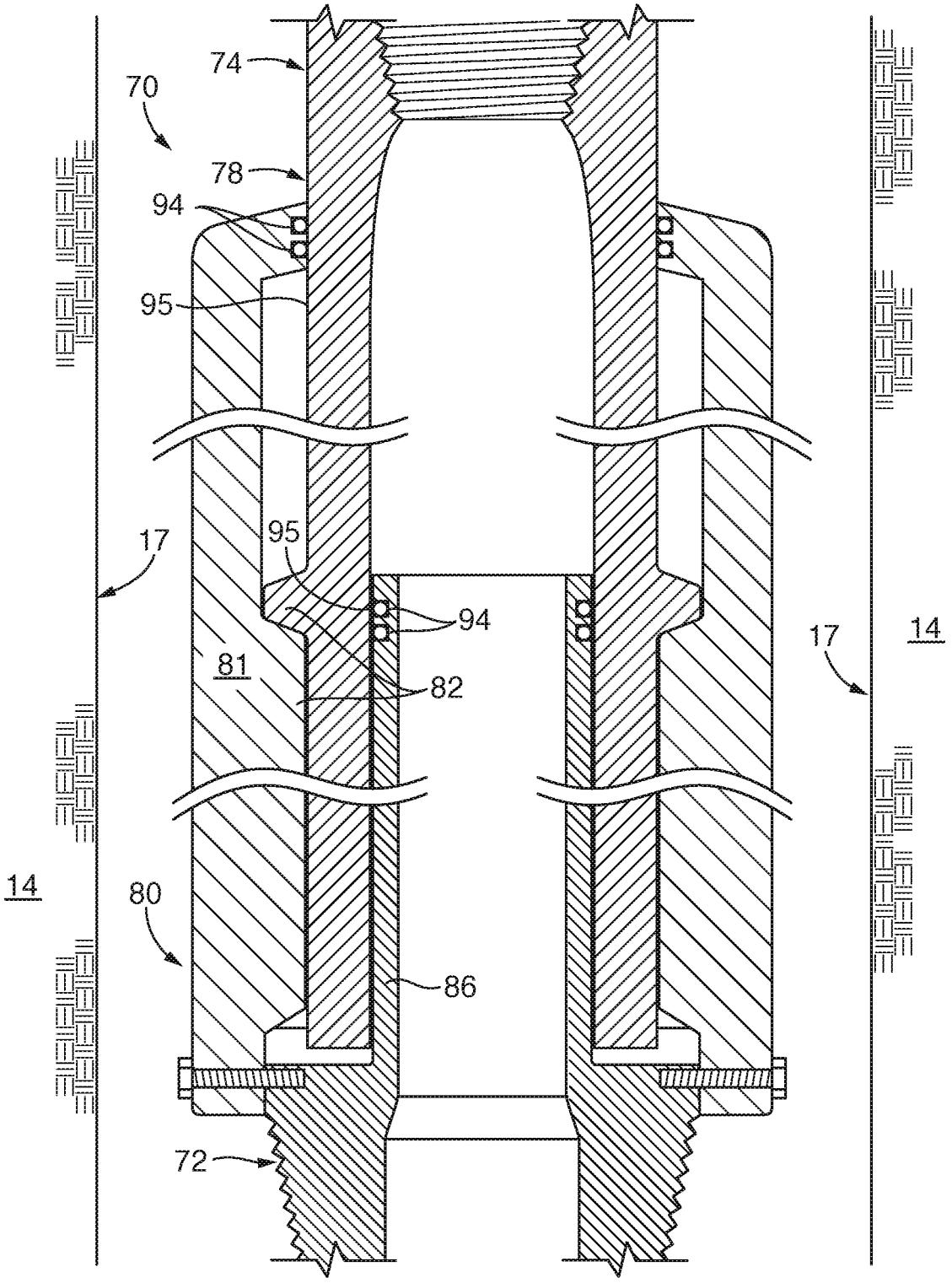
FIG. 3C is a side, elevation, schematic view of basic structures for an alternative embodiment of a "long reach" CAS (crash avoidance sub or crowding avoidance sub) in accordance with the invention.
Figure 3D:
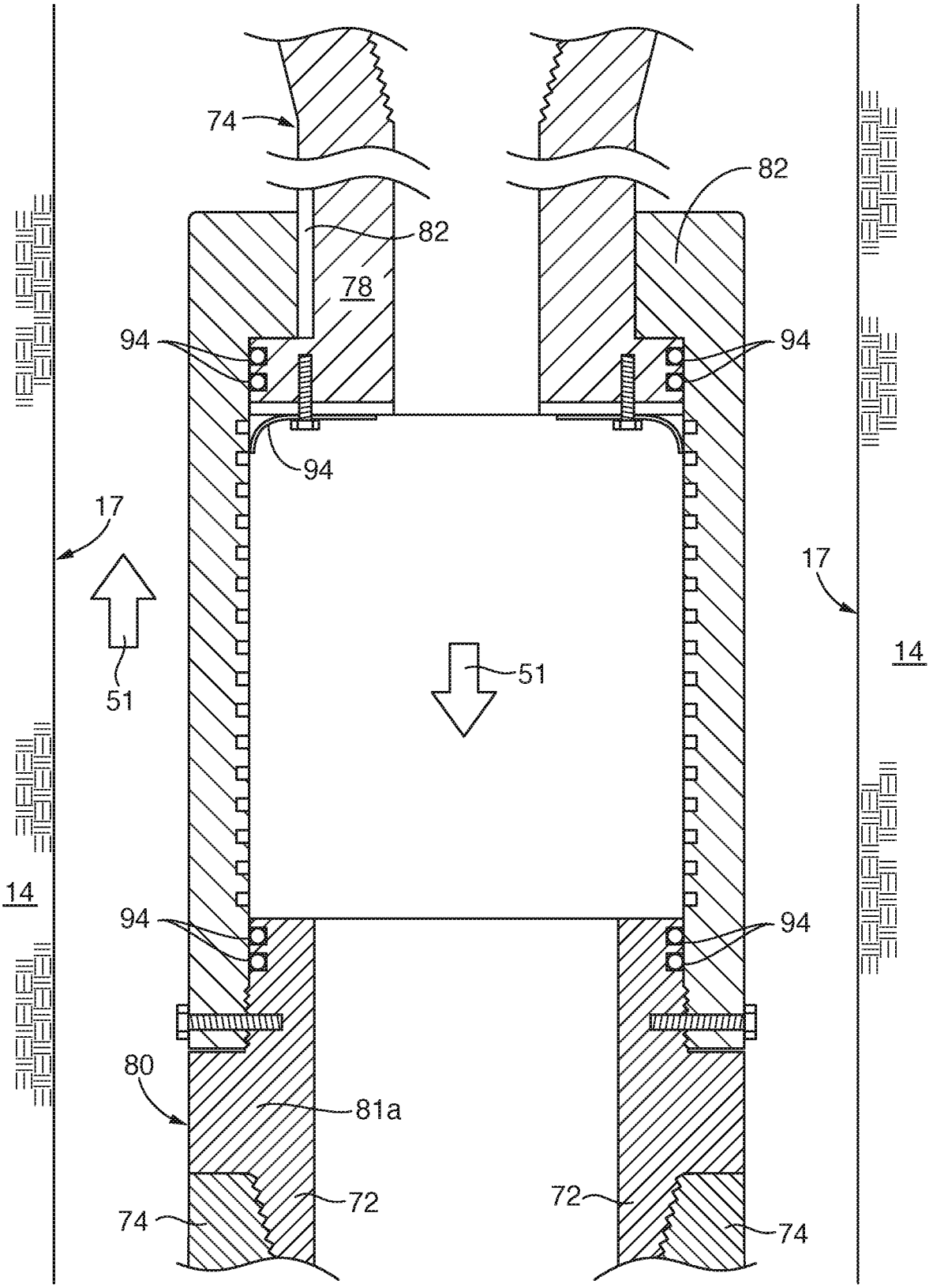
FIG. 3D is a side, elevation, schematic view of yet another alternative embodiment thereof.

Referring to FIG. 3C, while continuing to refer generally to FIGS. 3A through 4H, and more generally to FIGS. 1 through 13, a length of a cavity 84*a*, 84*b* as well as a length of splines 82 are related. For example, if splines 82 are to be engaged, they must be engaged at all times regardless of whether they fully overlap with one another or only overlap for a portion of their lengths. This requires that when the splines 82 are translating axially with respect to one another, as they cannot rotate with respect to one another, a portion of each spline 82 must have space to move away from engagement with the other.

Thus, in certain embodiments, one may ignore the cushioning function of the pressurized liquid within the cavities 84*a*, 84*b*, 97 and instead simply fill the space between the splines 82 of FIG. 3C with drilling fluid 51 from within the string 16. Now, a difficulty with this arrangement is that the splines 82 have nearly constant, reciprocating, relative motion, albeit small at times, and larger at other times. Accordingly, the grit present in drilling fluid 51 will operate as a grinding compound between the lands 83*a*, 83*c* and grooves 83*b*, 83*d* in operation. Meanwhile, in order to sustain pressure of the drilling fluid 51 inside the string 16 and the CAS 70, seals 94 must seal out the drilling fluid 51 passing upward between the CAS 70 and the wall of the bore 17.

Thus, all of this sealing has to do mainly with separating the pressure inside the CAS 70 or string 16 from the pressure outside. Sealing other than a smooth cylindrical surface, such as sealing splines is a thankless and nearly impossible job, especially in the presence of a very unclean environment. Thus, sealing splines may often prove impractical, expensive, and not clearly worth the effort in a drilling environment.

Figures 4, 4A, 4B, 4C, 4D, 4E, 4F, 4G, 4H:
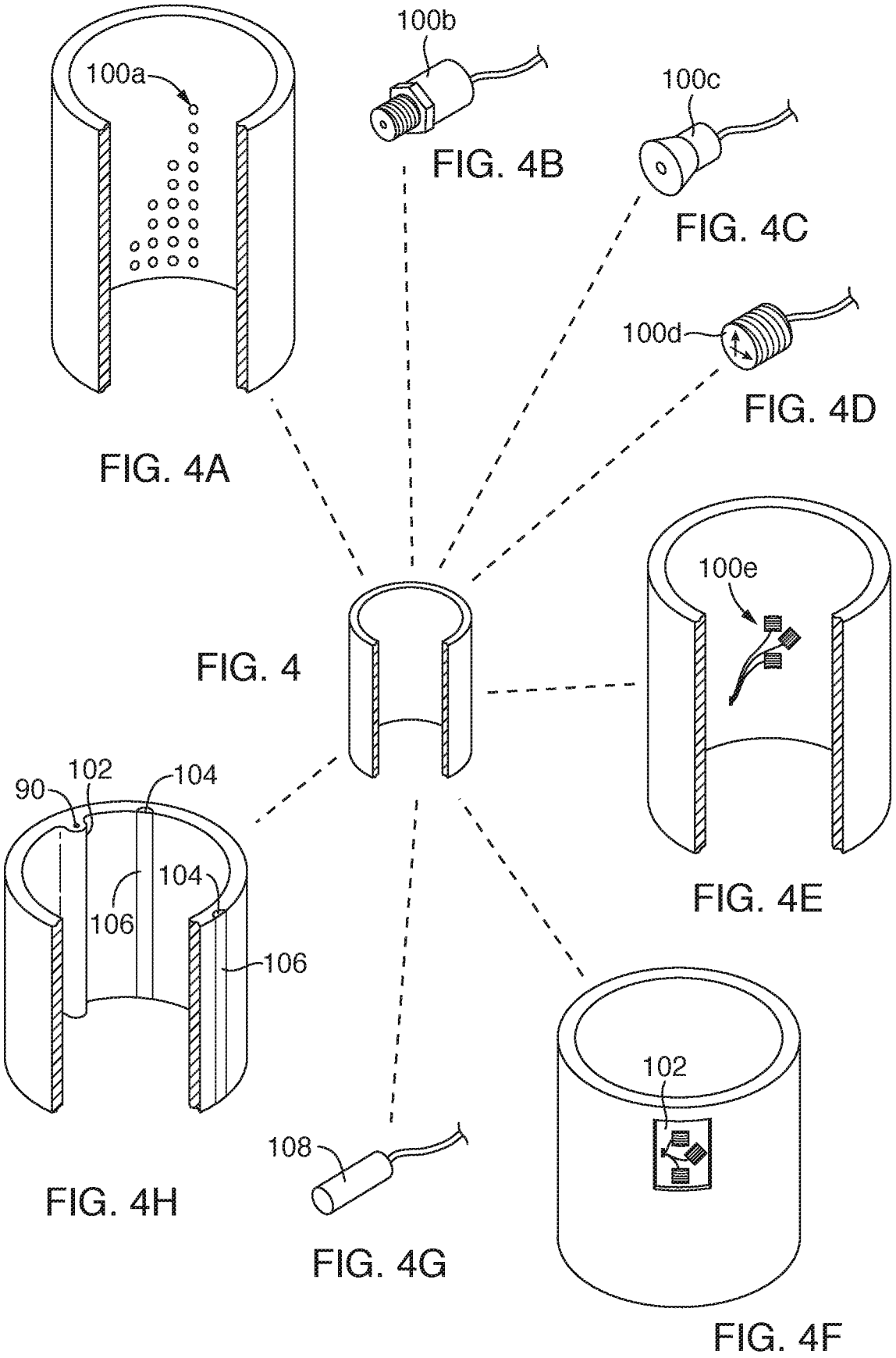
FIG. 4 is an exploded detail view of various optional sensor devices.
FIG. 4A is a schematic diagram of a magnet array for proximity sensors detecting position.
FIG. 4B is a representation of a pressure transducer.
FIG. 4C is a representation of a comparatively smaller piezoelectric pressure transducer.
FIG. 4D is a representation of an accelerometer for detecting acceleration, and therefore rates of change of velocity, which can be integrated to obtain velocity and position.
FIG. 4E is a representation of a strain gauge rosette in a surface mount configuration.
FIG. 4F is a representation of a strain gauge rosette in a recessed mount configuration.
FIG. 4G is a representation of a thermocouple, an electronic temperature measurement device.
FIG. 4H is a perspective view representation of various embodiments of physical channels for accepting data lines (wires) for data collection from sensors.

Referring to FIG. 4D, a CAS 70 may be configured to seal only against smooth cylindrical surfaces, and seal only drilling fluid 51, not clean lubricants like grease or oil. In the illustrated embodiment, drilling fluid 51 in the bore 17 is sealed away from drilling fluid 51 in the string 16 and BHA 50. A spline, being required to provide a reactionary torque (force in rotation) for the bit 18, is exposed to drilling fluid 51 in the bore 17.

The seals 94 and sealing surfaces 95 will be subject to wear, but need not maintain any "clean" region of oil or grease. Likewise, the splines 82 exposed directly to the drilling fluid 51 must be tolerant of abrasives. This militates for larger (radially deeper, axially longer, or circumferentially wider) splines 82 and perhaps softer materials.

Softer materials, such as elastomers, line the stator of a mud motor 48. Also, in gears, softer metals such as brass or bronze often wear better than harder metals, such as steels. All of this affects wear and lifetime in a CAS 70. However, to save a bore 17 from ever needing to trip out a bit 18 easily justifies such a simplified, single-hole, replaceable CAS 70.

Referring to FIG. 4, and particularly FIGS. 4A through 4H, various selective sensor arrangements and devices are illustrated. For example, in FIG. 4A, magnets 105 may be embedded in the interior walls of the base 81*a*. Meanwhile, a coil 106 which may itself have an iron core strengthening it as an electromagnet 106, detects proximity to each magnet 105. Rows 107 of magnets 105, each associated with and aligned with a coil 106 may provide continuing signals for the longest rows 107, and emergency warnings for the shorter rows 107 seldom engaged.

For example, if the leg 88 of the slide 78 ever approaches the comparatively shorter rows 107 of magnets 105, an emergency condition exists. Sensors 100*a* associated therewith experience a voltage change, reporting that a crash is forthcoming due to axial collapse if the feed rate is not abruptly stopped or reduced. Thus, the sensor 100*a* is one type of a displacement sensor 100*a* for determining the compression of the slide 78 into the body 80 indicating that the CAS 70 should trigger a reduction or cessation of feeding the string 16.

The pressure transducer 100*b* of FIG. 4B is typically threaded in from behind a surface at which a pressure is to be detected. Nevertheless, some thread in oppositely. Some may be held by a threaded collar into position. Connecting lines 90 pass data (typically a voltage) out to be processed. Similarly, with respect to FIG. 4C, small piezoelectric sensors that produce a voltage in response to force or pressure on a face thereof may be embedded into a wall wherever pressure needs to be detected. The mechanics of size, complexity, and installation procedure will vary with sensors 100 and may be accommodated to the size and scale required for the functionality of both drilling fluid sensors 100*b* and tool, clean area, pressure sensors 100*c*.

As illustrated in FIG. 4D, a solid state type of accelerometer 100*d* may be used, detecting either translation (linear) motion, rotation, or both. In fact, both types of sensors 100*d* may be used. Thus, any of the sensor systems 100*a*, 100*b*, 100*c*, 100*d* of FIGS. 4A through 4D may be embedded into walls internally, externally, or both, as access and need dictate.

Referring to FIG. 4E, a strain gauge rosette 100*e* may be installed on an inner or outer surface as needed. In fact, as in FIG. 4F, relief 102 may be machined into a surface in order to eliminate exposure of strain gauges 100*e* to seals 94, abrasion, flows of abrasive drilling fluids 51, or the like. The relief 102 may be potted 106 with a comparatively softer or more flexible material 106 in order that the strain gauges 100*e* adhere to and move (stretch) with the underlying metal surface not affected by anything else.

Referring to FIG. 4G, a thermocouple 100*g* is a very simple device made up of a bimetallic junction 108 of two metals having different metallurgical properties. The junction 108 produces a voltage across that junction 108 in response to changes in temperature. Thermocouples 100*g* may be used to correct for local conditions, to monitor for inappropriate conditions, or the like. Often, thermocouples 100*g* are used in order to calibrate or recalibrate other sensors 100 that may have temperature sensitivities. For example, metals typically swell with increased temperature, which may be detected by a thermocouple 100*g*.

Referring to FIG. 4H, various configurations of channels 104 containing signal wires 90 or other signal paths 90 may be formed by building onto a wall that is not a sealing surface 95, or by engraving or machining into a wall. Potting 106 may seal a wire 90 into the channel 104. Channels should not extend as an irregular cross-section into sealing surfaces inasmuch as seal fit and wear are problems. A circle or a right circular cylinder has the best properties in terms of pressure feedback, sealing, strength, wear, cleaning, and the like if maintained completely perfectly cylindrical. Variations cause damage, facilitate leaks, require alignment, and become otherwise very problematic. Sealing technology has long benefited from perfect circles, perfect cylinders, and perfectly smooth surfaces whether straight or curved.

Figure 5:
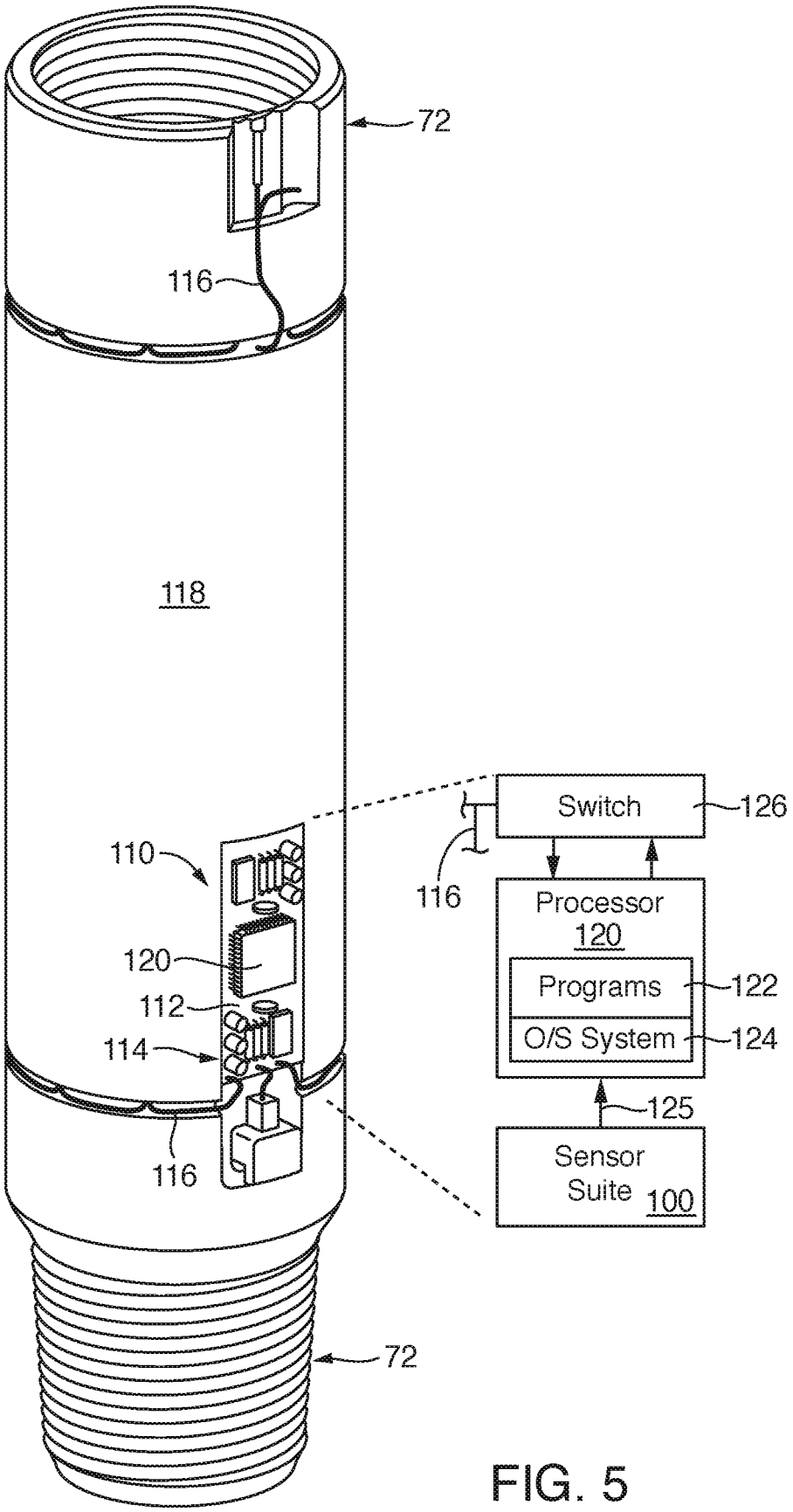
FIG. 5 is an outer, upper, perspective view, partially cut away, of a tube segment or sub containing programmable, data processing hardware.

Referring to FIG. 5, processing hardware 110 may be embedded within a CAS 70 or in another sub 52 above it. For example, in the illustrated embodiment, a heat resistant, printed circuit board 112 (PCB 112) may mount the electronics 114 to power, read, and process a signal from a sensor 100. In the illustrated embodiment, various connections 116 may represent wires 116 or a bus 116 interconnecting electronic components 114. Typically, the processing hardware 110 may be sealed within a shell 118 to protect the components 114 such as a processor 120 from damage from mechanical or thermal events or effects.

Meanwhile, a processor 120 may be programmed by either electronically erasable programmable read only memory (EEPROM), by conventional digital processor programming, or may be a preprogrammed (PROM). Firmware pre-programmed and unchangeable is a great option with a rapid response. Specific functionalities in programs 122, the processor 120, or both may be less susceptible to electrical surges, stray currents, thermal effects, other distortions, or the like.

Regardless, whether in firmware, hardware, or conventional digital programming, programs 122 through an operating system 124 may be placed into the processor 120 to receive, manage, transmit, order, or even preprocess signals 125 received from the sensors 100 or the sensor suite 100 within the CAS 70. Ultimately, a processor 120 has a principal function of interfacing with a switch 126 connected to a network 116 passing throughout the string 16 to communicate to data stations 22 at the surface 15.

The "hardening" of processing hardware 110 to tolerate a bore 17 environment may require reliance on such protocols as military specification for extreme environments. For example, commercial electronics typically have comparatively narrow temperature requirements, cleanliness requirements, ventilation, and so forth. On the other hand, certain military equipment for arctic, desert, or dirty environments may be hardened, sealed, and otherwise qualified to operate in more severe circumstances of uncleanliness and temperature extremes. Thus, one cannot promise that the processing hardware 110 will be as ubiquitous and inexpensive as commercially available civilian types of computers and other associated peripherals, but is still within the realm of currently available components.

Figure 6:
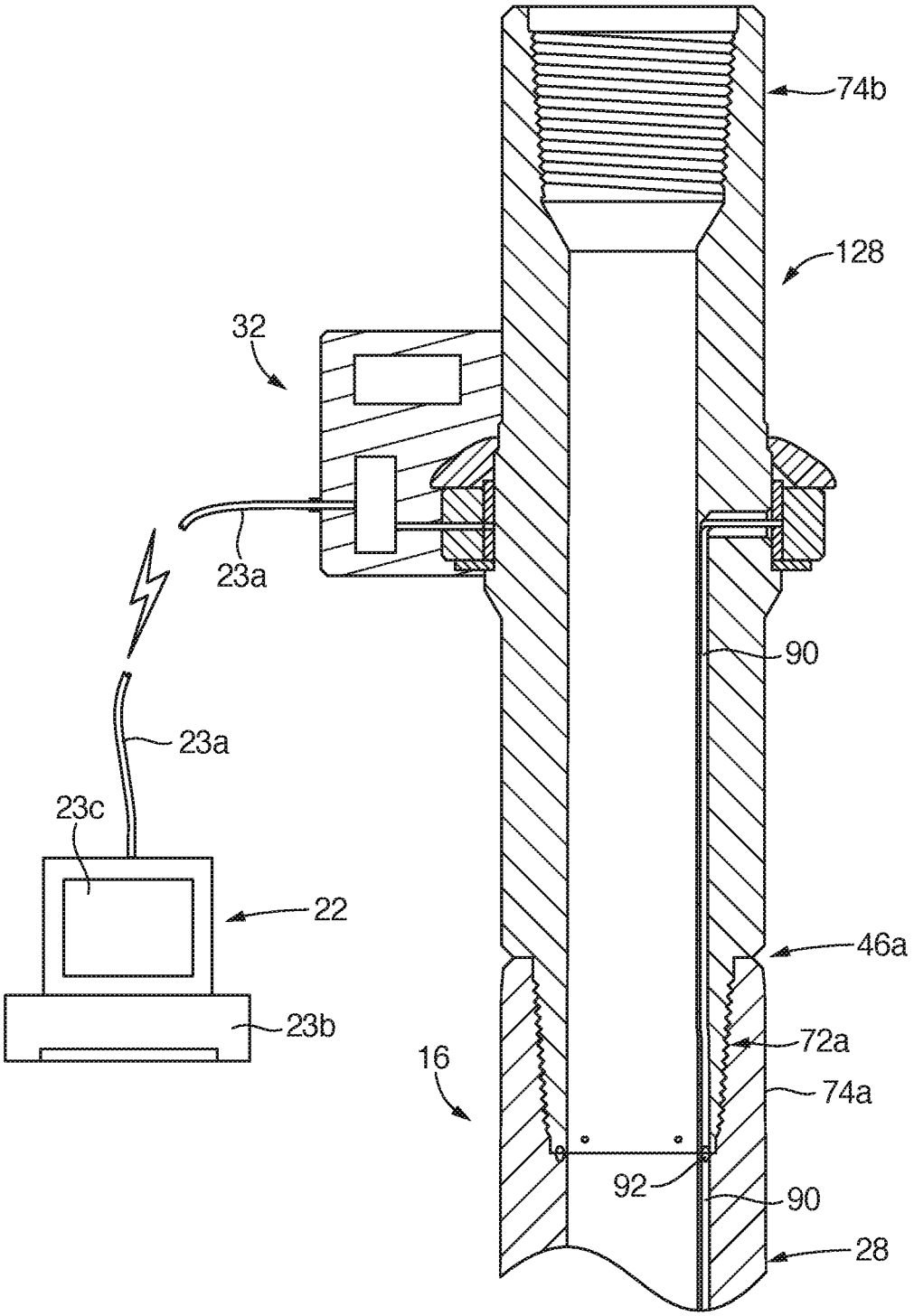
FIG. 6 is a side, elevation, cross-sectional view of one embodiment of a swivel for transmitting data from a drill string out to a data station for processing or additional processing.

Referring to FIG. 6, while continuing to refer generally to FIGS. 1 through 13, the top tube 128 typically extending from the "hook" 30 to the first drill tubing 28 in the string 16 will need to pass data from the sensors 100 and their processing hardware 110 to a data station 22 or work station 22 by way of a line 23*a*, 90 or other link 23*a*. Again, in order to propagate a signal at such distances, processing hardware 110 may need to include signal boosters, filters, and other mechanisms to improve the signal-to-noise ratio of the signal. Meanwhile, certain preprocessing, data manipulation, and filtering may also be done by the electronics 114 on the circuit board 112 associated with any particular CAS 70. To that end, various slip rings and other contact devices may operate in a comparatively cleaner environment of the swivel 32 above the drill string 16.

Here, the top tube 128 containing the swivel 32 is threaded by its pin 72*a* into the box 74*a* of the next tube 28. Meanwhile, contacts 92 between the tubes 28 and 128 as well as data lines 90 may propagate and connect to provide access to the signals arriving from the sensors 100, processing hardware 110, and so forth down hole in the bore 17. For example, see the patents incorporated by reference hereinabove.

Figure 7:
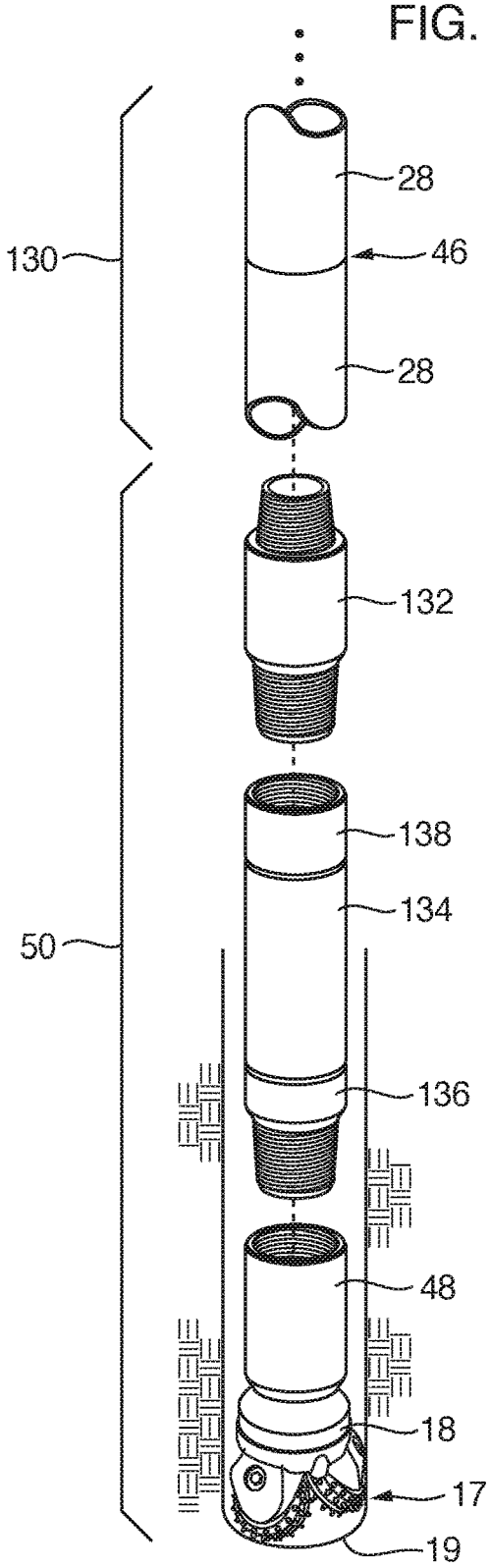
FIG. 7 is a schematic diagram of various components in a drill string, including the bottom hole assembly, illustrating various locations in which a CAS may be positioned within the drill string.

Referring to FIG. 7, typical drill strings 16 may include a suspended portion 130, which, as mentioned hereinabove, may be considered one definition of the drill string 16. However, the BHA 50 operates to provide the weight on the bit 18 (WOB). For example, in the illustrated embodiment, the suspended portion 130 or the suspended string 130 typically extends from the hook and top tube 128 down to, but not including, the BHA 50. Meanwhile, below the suspended string 130 lies the BHA 50 in which all of the constituent members are in compression.

Elements within the BHA 50 may include, for example, a cushion sub 132. A cushion sub 132 provides a certain force cushion between the comparatively larger weight of the suspended string 130 if the rate of penetration of the bit 18 reduces for any reason. For example, the cushion sub 132 prevents chattering forces abruptly striking with impact load between the suspended string 130 and the bit 18. Since a physically rigid connection will typically exist at each joint 46 between adjacent tubes 28, an impact would increase loading on the bit 18 as a portion of the suspended string 130 changes from being in suspension (tension) into compression against the BHA 50. Such crowding would translate directly to an impact load between the bit 18 and the cutting face 19. Thus, to avoid such a situation, a cushion sub 132 may be inserted into the BHA 50 or between the BHA 50 and the suspended string 130.

Similarly, other subs 138, for example, a shock sub 136 may provide which has a similar function to that of a cushion sub 132. Such may often be positioned lower in the BHA 50, closer to the bit 18. A jar 134 in the BHA 50 is typically an impact tool used when a bit 18 has been impacted into the cutting face 19. Such an event is unwanted, may cause damage to the bit 18, may stall the motor 48 above the bit 18, and may damage or destroy either or both.

Typically, damage to a motor 48 occurs when the motor is stalled due to the bit 18 being unable to rotate. Braking the rotor of the motor 48 to a stop may cause bypassing by drilling fluid 51, and possibly cutting into polymer layers in the stator portion of the motor 48. Thus, a shock sub 136 may prevent impact loads tending to precipitously add load to the bit 18 and thereby drive it into the cutting face 19 damaging, stalling, or both the bit 18, motor 48, or both.

A jar 134 typically operates by storing energy in a spring or the like up to a certain trip load or threshold value. When that threshold value is reached, certain components release, causing a release of an impact force upward on the BHA 50.

One way to remedy an impacted bit 18 in the cutting face 19 or a stalled mud motor 48 due to the same cause is to draw additional tension on the entire string 16, until the total of the suspended string 130 begins to put into tension the BHA 50. Thus, the jar 134 is also a relative movement mechanism 134 having two components, similar to a cushion sub 132. These two relatively movable elements are drawn apart in order to store energy. One heavy component is suddenly released upon triggering, delivering an impact load upward on the remainder of the BHA 50 therebelow. Dislodging the bit 18 from impaction may or may not restore a BHA 50 to operation, depending on damage.

A CAS 70 may be built into a structure of a cushion sub 132. In certain embodiments, a cushion sub 132 may be adapted to operate as a CAS 70. On the other hand, using certain components of a cushion sub 132, a CAS 70 may be configured as described hereinabove. Likewise, a jar 134 typically has a much longer stroke between the relatively movable (movable relative to each other) elements. Thus, a jar 134 may be configured as a CAS 70. More likely, components of a jar 134 may be repurposed to provide the function of a CAS 70 with a comparatively longer stroke than would appear in a shock sub 136 or cushion sub 132. Nevertheless, a comparatively long stroke of from about four feet to eight feet as in FIGS. 4C and 4D would fit well between the suspended string 130 and BHA 50, and need not carry axial load.

Figure 9:
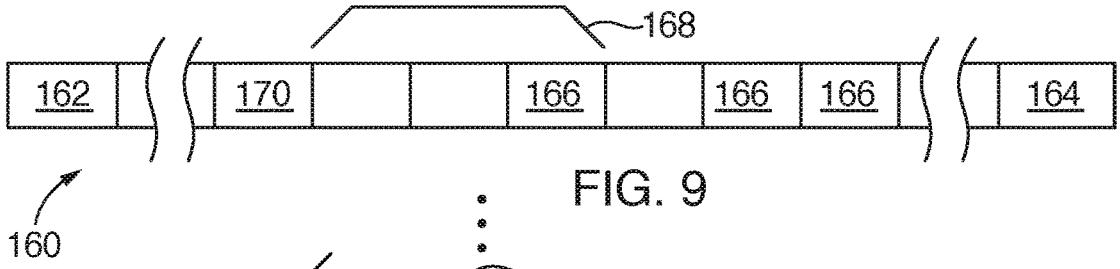
FIG. 9 is a schematic block diagram of a "data string" or "data packet" passed from a drill string to a data station for further processing.
Figure 8:
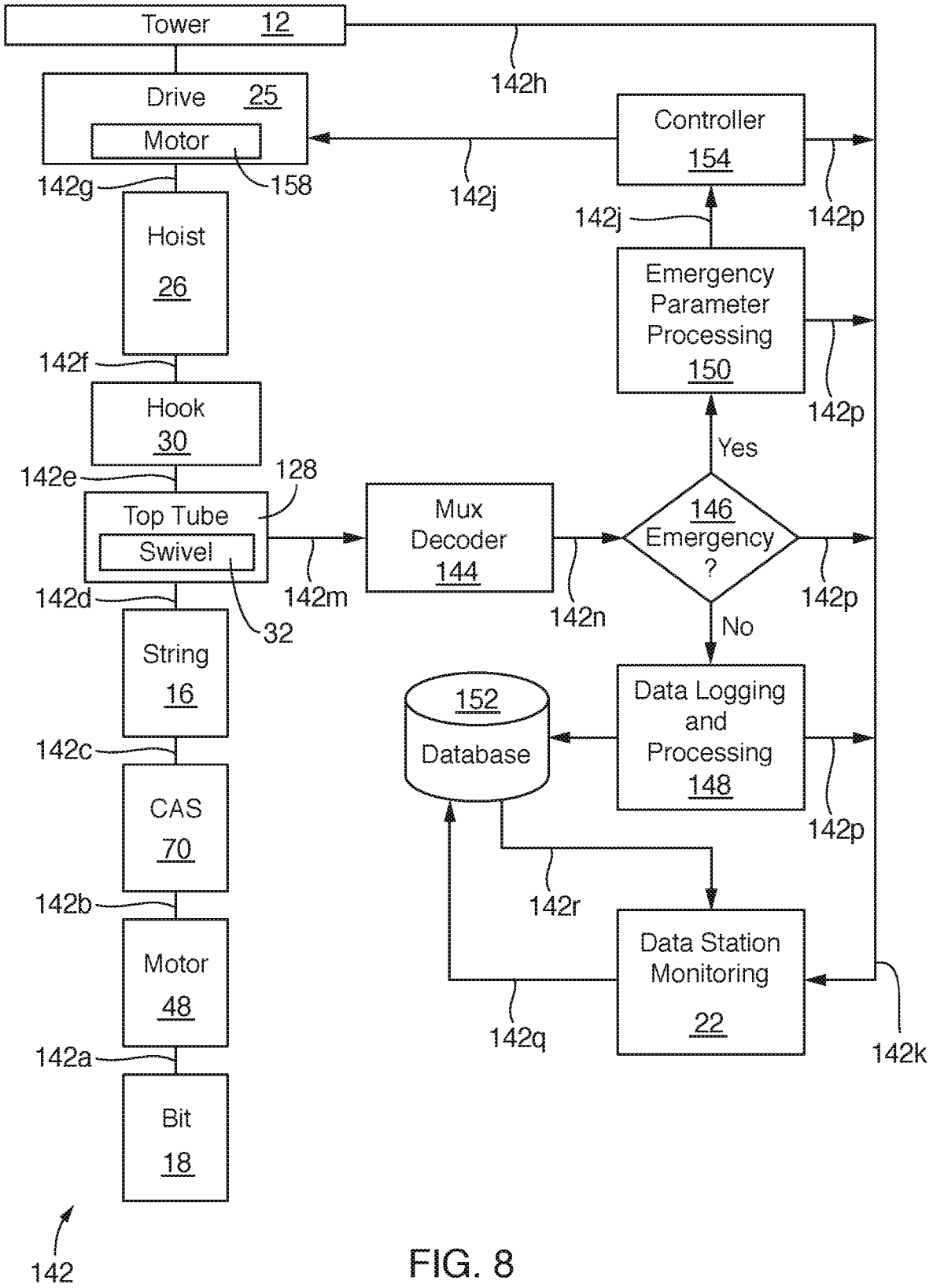
FIG. 8 is a schematic block diagram of a connection scheme for data collection, processing, and feedback to control the feed drive lowering a drill string into a drilling bore.

Referring to FIGS. 8 and 9, while continuing to refer generally to FIGS. 1 through 13, a connection scheme is illustrated schematically with various connections 142 between various elements. For example, in the illustrated embodiment, a bit 18 may connect through a connection 42*a* that is entirely mechanical to a rotor of a mud motor 48. Meanwhile, the mud motor 48 may connect through a rigid mechanical connection through a matching set of pin 72 and box 74 constituting a connection 142*b* to a CAS 70.

Passing electrical contacts through a rotor of motor 48 is a daunting task. In the currently contemplated environment, several individual subs 52, 70, 132, 134, 136, 138 may be individually installed or replaced rather than integrating so one function may fail another. Individually, each is simpler to manufacture, service, or maintain. Thus, in currently contemplated embodiments, the mechanical connection 142*a* may be fixed with respect to the stator of the motor 48, which results in the bit 18 being connected to rotate with respect to the housing of the motor 48. Meanwhile, the connection 142*b* may be a rigid mechanical connection due to the threading between the corresponding pin 72 and box 74 forming a joint 46 thereat.

Remembering that a CAS 70 may be located anywhere in the BHA 50, being closer to the bit 18 has distinct advantages, including the proximity to the action by the bit 18. One advantage of the CAS 70 being close to the bit 18 is that it can detect exactly the motion of the motor 48, the closest component 48 to the bit 18. Nevertheless, a CAS 70 may very profitably be given a very long stroke, meaning feet rather than inches, even on the order of three feet to ten feet of stroke if it is located near the top of the BHA 50 or between the BHA 50 and the suspended string 130. An advantage to a CAS 70 having a relatively long stroke on the order of several feet rather than a foot, a couple of feet, or less, is greater traverse or travel in relative motion between an upper movable element with respect to a lower movable element.

Such a CAS 70 would provide more time and space to be able to detect, report, and respond to crowding. At a feed rate of four feet per minute, with only a foot of slack, a crash will occur in 15 seconds against a stalled bit 18. Much more time is available if the suspended drill string 130 can have more distance to descend on the BHA 50 in the absence of a suitable rate of progression by the bit 18 itself. Meanwhile, the CAS 70 need carry no axial load. Thus, there are advantages of having the CAS 70 as close to the bit 18 as possible, but also advantages of having the CAS 70 located exactly between the suspended string 130 as it transitions to the BHA 50.

As the BHA 50 extends upward, it may contain several elements. Unless a particular element in the BHA 50 involves support of the CAS 70 or constitutes another CAS 70, the connection 142*c* need only be sufficiently operationally electronic to pass signals between the sensors 100 and the data station 22 at the surface 15. In the presently illustrated configuration, the connection throughout the string 16 up to the connection 142*d* at the top tube 128 containing the swivel 132 is basically rigid mechanical and electronic. The electronic connection carries the data from the sensors 100.

The mechanical connection supports the mechanical load of the suspended string 130 as well as the internal pressure of drilling fluid 51 inside the entire length of the string 16. Not shown is a top sub having a functionality similar to the swivel 32, but passing in drilling fluid 51 or "drilling mud" 51, down the internal diameter of the entire string 16 and BHA 50.

Meanwhile, as described hereinabove, the top tube 128 with the swivel 32 passes a connection 142*m* out on a line 23*a* to a multiplexer 144 or decoder 144. In fact, the decoder 144 may be considered a multiplex (MUX 144) for separating out signals that have been combined in a format according to a suitable multiplexing protocol. Thus, the connection 142*m* need only be an electronic link 142*m*, with sufficient mechanical connection 142*m* to support such a data connection 142*m*.

Above the top tube 128 the connection 142*e* need only be a mechanical loading connection from the tower 12, hoist 26, and hook 30 to the string 16 by way of the top tube 128 engaged therewith. Meanwhile, the connection 142*f* between the hoist 26 and the hook 30 is strictly a mechanical connection, or need only be. Various types of electronic connections may be used, but a swivel 32 is a convenient connection scheme for taking a signal out to the MUX 144 to be decoded and forwarded for storage and possibly immediate use.

Of course, the hoist 26 is typically connected by a mechanical connection 142*g* constituted by chains, cables, or the like in a "leveraged" condition. That is, a typical hoist 26 will involve multiple loops of cable or chain around pulleys at opposing top and bottom ends thereof. Thus, a drive 25 may include a motor 156 driving the cable or other flexible element of the hoist 26 to take up slack or release slack in order to raise or lower, respectively, the hook 30. Of course, the drive 25, and the hoist 26 are all supported by virtue of the tower 12 or derrick 12 and are typically mounted on or near the upper deck 24 thereof.

The data connection 142*m*, having delivered a signal to the MUX 144 for decoding results in a data string 142*n*, 160 (see FIG. 9) or a signal 142*n* passing along a connection 142*n*. That is, one may speak of the connection 142*n*, or the content of the connection 142*n*. The point is that data is passed to a test 146 executed by a processor 146 of any suitable type, so programmed. Saving a bit 18 involves more than the cost of a bit 18. The cost of a trip far outweighs the cost of a mud motor 48 or bit 18 destroyed in a crash of the bit 18 into the cutting face 19.

Referring to FIG. 9, for example, the test 146 immediately processes a data string 160 containing data segments 166 in a particular order according to the protocol of the MUX 144, the network 116, and the switches 126. Accordingly, certain information is immediately copied out of the data string 160 to be delivered to an emergency parameter processor 150.

That is, if certain triggering information 170 following a header 162 in the data string 160 is present, then the test 146 immediately passes out key emergency information 168. Optionally a trigger information segment 170 may suffice to the emergency parameter processor 150. A portion of a processor may be programmed to respond to the trigger 170 as a highest priority, with or without other emergency data 168.

Otherwise, as a matter of course, the test 146 passes data 142*p* along a connection 142*p* to a monitoring data station 22, for immediate display or comparatively quick display. Meanwhile, conventional 114 required processing 148 may occur if the test 146 determines emergency data 168 or trigger data 170 is not contained in the incoming data string 160. Thus, conventional data logging and processing 148 may occur in a processor 148 dedicated to the task or a portion of a processor 148 programmed to process the data and store it in a database 152.

Meanwhile, a monitoring data station 22 associated with any user, or station 22*a*, 22*b*, 22*c*, or the like may receive the monitoring information along the connection 142*k* monitoring the controller 154, the emergency parameter processor 150, the test 146, the data logging and processing 148, and so forth. Thus, each of the connections 142*p* may amount to a monitoring link 142*p*. Of course, a monitoring data station 22 may also maintain a connection 142*q* for querying the database 152 and a response connection 142*r* for receiving requested information from the database 152. These may be conventional network connections on a bus, so long as emergency information 168, 170 receives the highest priority.

In one currently contemplated embodiment, the data station 22, or the operators and their intervention, are completely bypassed by the emergency parameter processor 150. Instead, that emergency parameter processor 150 sends a signal 142*s* directly to the controller 154 instructing the drive 25. The controller 152 acts in a preprogrammed, automatic response to begin slowing and possibly even reversing the drive 25 in order to stop the rate of progress of the suspended string 130.

That is, the hoist 26 will "immediately" be stopped by the drive 42, although thermodynamics teaches that nothing actually happens in zero time. Thus, the hoist 26 will stop as rapidly as feasible and as rapidly as necessary to protect the BHA 50 from being loaded with the weight of the suspended string 130 thereabove. This way, the sensor parameters 168, 170 are processed immediately and first if they report an emergency condition. The connection 142*j* may be on a bus along with every other connection 142. Meanwhile, the connection 142*h* reports the condition of the drive 25 back to the data station 22.

If the feed rate of a drive 25 lowering a hook 30 supporting the string 16 is comparatively high, which is typically about four feet per minute, then fifteen seconds would constitute one foot (thirty centimeters) of travel. Thus, a length of travel between movable elements of a CAS 70 should typically be at least two to eight feet. Elapsed time corresponding is half a minute to two minutes. Of course, specific times, loads, transition times, and the like will necessarily depend on the length of the overall string 16, the total weight, and the like.

Since the suspended string 130 is all in tension, there will not be a need to reverse the axial loading in the suspended string 130 from a compressive load and a compressed length to a tensile load and an extended length. Thus, a response time may be comparatively quick, on the order of seconds, thus providing ample time and distance to prevent the descending of the suspended string 130 onto the BHA 50. Still, reversing a string 16 of a million pounds mass, or stopping it, requires a corresponding expenditure of time and energy at the derrick 12.

Referring to FIG. 9, a data string 160 may be passed along a communication line 90 by way of the switches 126 and processors 120. Typically, the data segments 166 in the data string 160 contain information submitted or originating from the various sensors 100 in the BHA 50. As a practical matter, various data segments 166 may be identified by any suitable addressing mechanism. Network protocols suffice, but dedicated analog lines 90 are possible.

The format, including the number of data segments 166 in a packet 160, their order, their senders 100, and destinations may all be determined in advance. For example, in a typical code-division multiplex system 144 certain signals, frequencies, or positions in a data string 160 may be dedicated to specific information. In other situations, decoding information for the data string 160 may actually be contained in the data string 160 itself. By either mode, it is contemplated in accordance with the invention that certain header information 162 indicates the beginning of a specific data string 160. Certain predictable coding in a trailer 164 indicates the end of the segment 160, such as a packet 160. Meanwhile, the individual segments 166 will typically be measured out in some specific number of bits, bytes, or words, in a computer sense.

It may be advantageous to include certain sensor segments 168 shortly following the header 162 to be read and processed ahead of other data in other segments 166. For example, many computers 23*b* are interrupt driven. Accordingly, certain processes may be given higher priority than others. Certain emergency information 168 or emergency segments 168 may be dedicated as sensor segments 168, including an emergency trigger segment 170.

In other words, regardless of whether data is received and processed in order of receipt, in order of some other priority, or the like, the sensor segments 168 are critical to operations. Thus, data logging, other detailed data analysis, information of historical interest, and the like are best relegated to processing, or even reading, offline or after the sensor segments 168 have been read and responded to.

In particular, it is contemplated that an emergency trigger segment 170 be processed first in every case. For example, it is a principal objective of a system 10 in accordance with the invention to avoid crowding the bit 18, or even loading (applying force, stress, or pressure) by the suspended string 130 onto the BHA 50 under any circumstance. A bit 18 is designed to operate under the load (WOB) of the BHA 50, never that of the suspended string 130.

This is easy to understand when one considers that the entire BHA 50 may typically weigh less than sixty five thousand pounds, whereas the entire suspended string 130 may weigh a million pounds. The ratio between those two loads illustrates the stark reality of crowding or loading the BHA 50 by the suspended string 130, and consequently crowding or crashing the bit 18 into the cutting face 19.

Thus, by giving highest priority to the trigger segment 170 or emergency segment 170 and the sensor segments 168, no other information receives higher priority, is read earlier, nor is processed more quickly. A "hot line" link for that data 168, 170 to override control of the feed rate at the hook 30 in accordance therewith may be just as important.

Thus, at a typical rate of penetration of about four feet per minute, seconds matter. Likewise, the CAS 70 or multiple CAS systems 70 in the BHA 50, as well as between the suspended string 130 and the BHA 50 can assure sufficient travel permitted by the suspended string 130 before it can begin loading the BHA 50. Thus, since the suspended string 130 is in tension, and the BHA 50 is in compression, a non-resistive spline system 70 as a CAS 70 may be installed. Resistance provides certain benefits, but need not be required at the suspended string 130 to BHA 50 interface. A distance that must be traversed vertically by the suspended string 130 needs to provide time enough for intervention before it is permitted to load the BHA 50.

Thus, distance, properly equipped with sensors 100 to report through the processing hardware and switch 126 onto the data lines 90 can save much difficulty. In operation, the simple principle of detecting relative motion between movable components 78, 80 in a CAS 70 can be reported to the data stations 22 at the surface 15 to immediately begin a slowdown and shutdown of the rate of penetration of the string 16.

By providing a proper priority to the sensor segments 168 and the trigger 170, and providing electronic reporting of that information 168, 170 immediately, the controller 154 may instruct the drive 122 to halt as rapidly as possible the vertical descent of the string 16. With million dollar trips at stake, the priority, processing, based on sensor data 168 and emergency trigger 170 are well justified.

Figure 10:
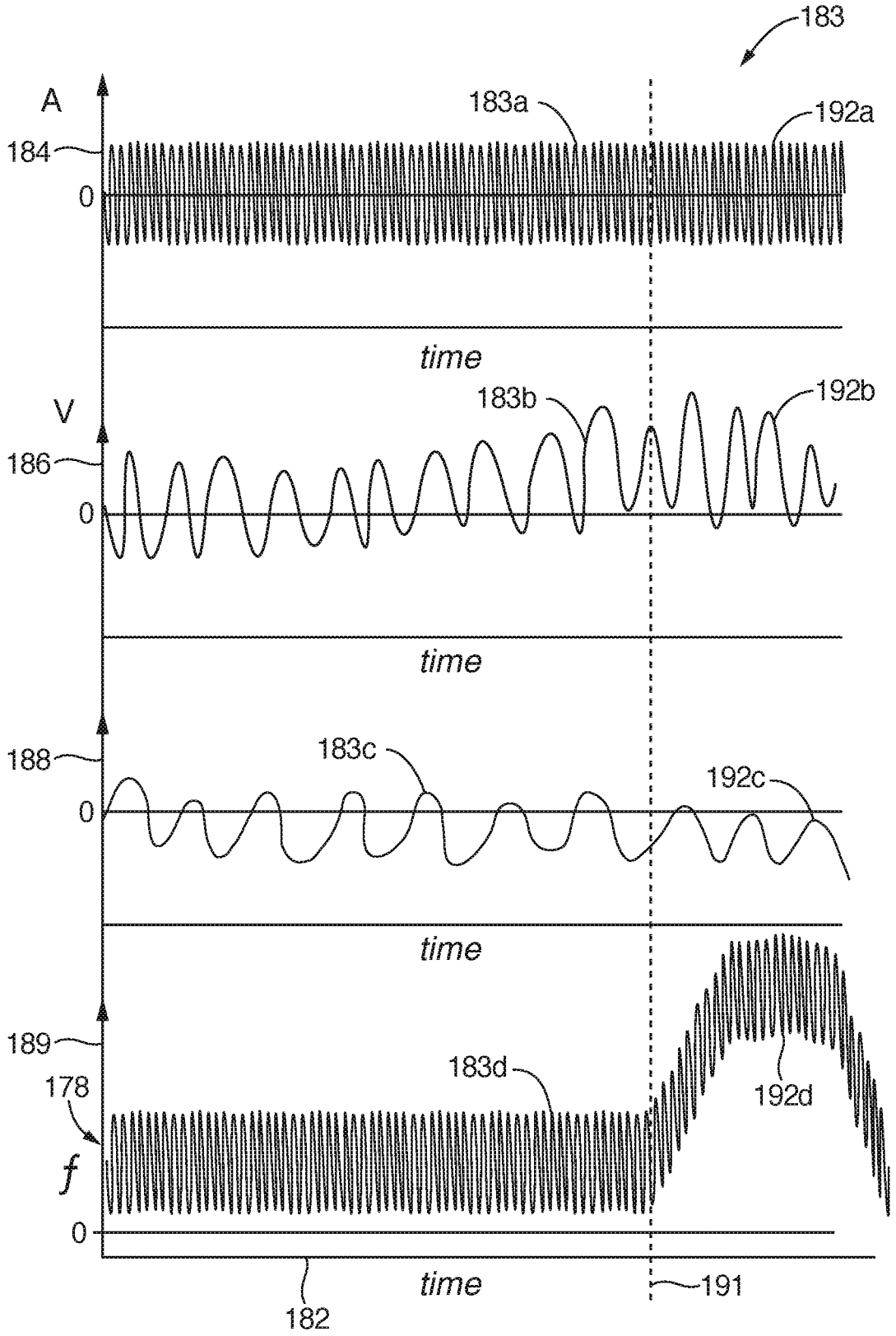
FIG. 10 is a chart illustrating acceleration, velocity, displacement, and frequency as a function of time as they typically appear from sensors, and after processing.

Referring to FIGS. 10 through 13, while continuing to refer generally to FIGS. 1 through 13, charts 180 illustrate the nature of time traces for various parameters sensed by and reported by sensors 100. In FIG. 10, time is represented on a horizontal axis 182, while a vertical axis 178 displays a function or output of a sensor 100. Several curves 183 coincident in time are illustrated along the vertical axis 178.

For example, the curve 183*a* represents acceleration, while the curve 183*b* represents velocity 186, the mathematical integral of acceleration 184. Meanwhile, the curve 183*c* represents displacement or travel, an integral of velocity 186, which is itself an integral of acceleration 184. Frequency 189 is also illustrated in the curve 183*d*.

In the mechanical environment of the BHA 50, jarring, rapid motion and the like are very noisy, as well as legitimately variable values for each of the parameters 184, 186, 188, 189 in the chart 180.

Figure 11:
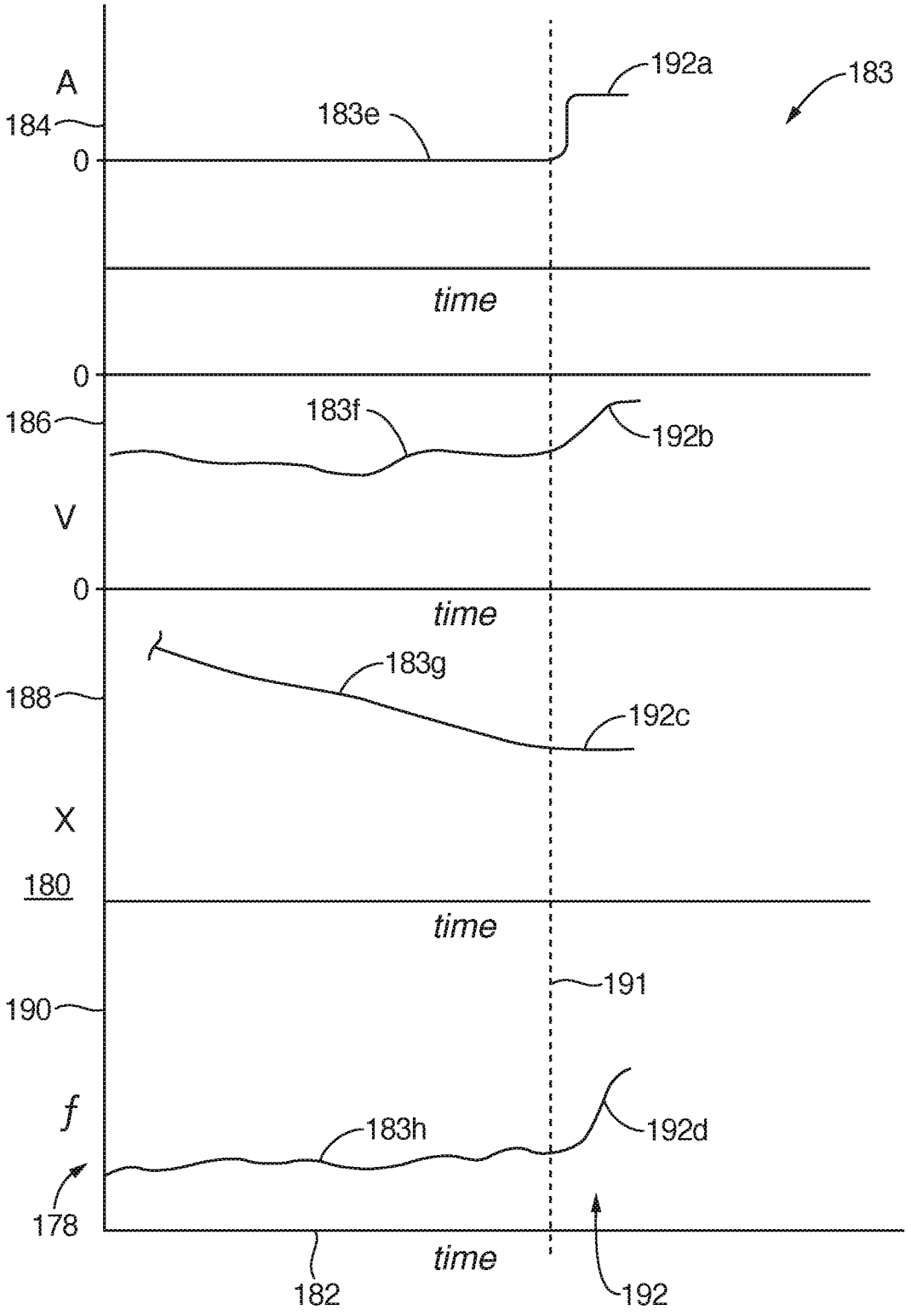
FIG. 11 is a chart illustrating, as a function of time, a smoothed or averaged acceleration, velocity, position, and frequency in order to detect an event anomaly representing a danger of crowding or crashing a bit.

Referring to FIG. 11, the values in the chart 180 when smoothed, filtered, averaged, or otherwise processed to remove the high frequency variations with time show the net changes in the parameters 184, 186, 188, 189. For example, acceleration 184 has a net value only slightly below zero. That is, where vertical acceleration is downward with downward being represented by value, a negative acceleration is zero at any constant velocity 186, but may change in response to force at any given moment. Thus, the net acceleration is basically zero.

Similarly, velocity 186, which is an integral of acceleration, may vary somewhat but only modestly, and maintains its constant negative value and direction. Likewise, position 188 or distance 188 again is an integral of velocity 186 and progresses steadily downward. There may be some slight variation. Large variations reflect momentary jarring, bouncing, vibrating, and errors resulting. Progress of a million pounds of steel is comparatively steady, with typical net variations being comparatively small, due to the adding of tubing segments 38, or slight variations in the hardness of the formation.

Likewise, the frequency 189, when smoothed, becomes the average frequency 190 or smoothed frequency 190 as displayed with respect to the vertical axis 178 across time 182.

Referring to FIG. 11, at a time 191, an event 192 or anomaly 192 begins, as illustrated in the traces 192*a*, 192*b*, 192*c*, 192*d*. One will notice that acceleration may suddenly rise. This is also reflected in that acceleration changing velocity 186 to slow it from its negative progression to move it toward stopping or slowing at some lesser absolute value. Meanwhile, the downward progress of descent 188 or distance 188 is seen to reduce substantially and approach zero progress 188. Meanwhile, it has been observed that the frequency 189 and the average frequency 190 likewise rise in response to a bit 18 encountering a harder, less penetrable cutting face 19 in the formation 14.

Each of these curves 183*e*, 183*f*, 183*g*, 183*h* is detected by a suitable sensor 100 selected for the task. Frequency 189, 190, however may be detected in the curves 183*a* through 183*d* by virtue of each reversal of direction of any curve 183. Thus, multiple sensors 100 may yield frequency of motion, either in acceleration 184, velocity 186, position 188, or the like.

The occurrence of the anomaly 192 at the time point 191 is detected by the various sensors 100, and reported by all. If processing hardware 110 is available in close proximity to the sensors 100, then a trigger 170 and the other sensor segments 168 may be filled at that point to be readily readable and interpretable by a data station 22 at the surface 15. Accordingly, upon detection of the anomaly 192, the controller 154 may immediately instruct the drive 122 to go into a routine to slow and stop the forward progress or downward descent of the string 16. Again, having the maximum available travel between relatively movable elements 78, 80 in a CAS 70 will permit more time for detection, reporting, and response to the curves 183 reflecting the anomaly 192.

Figure 12:
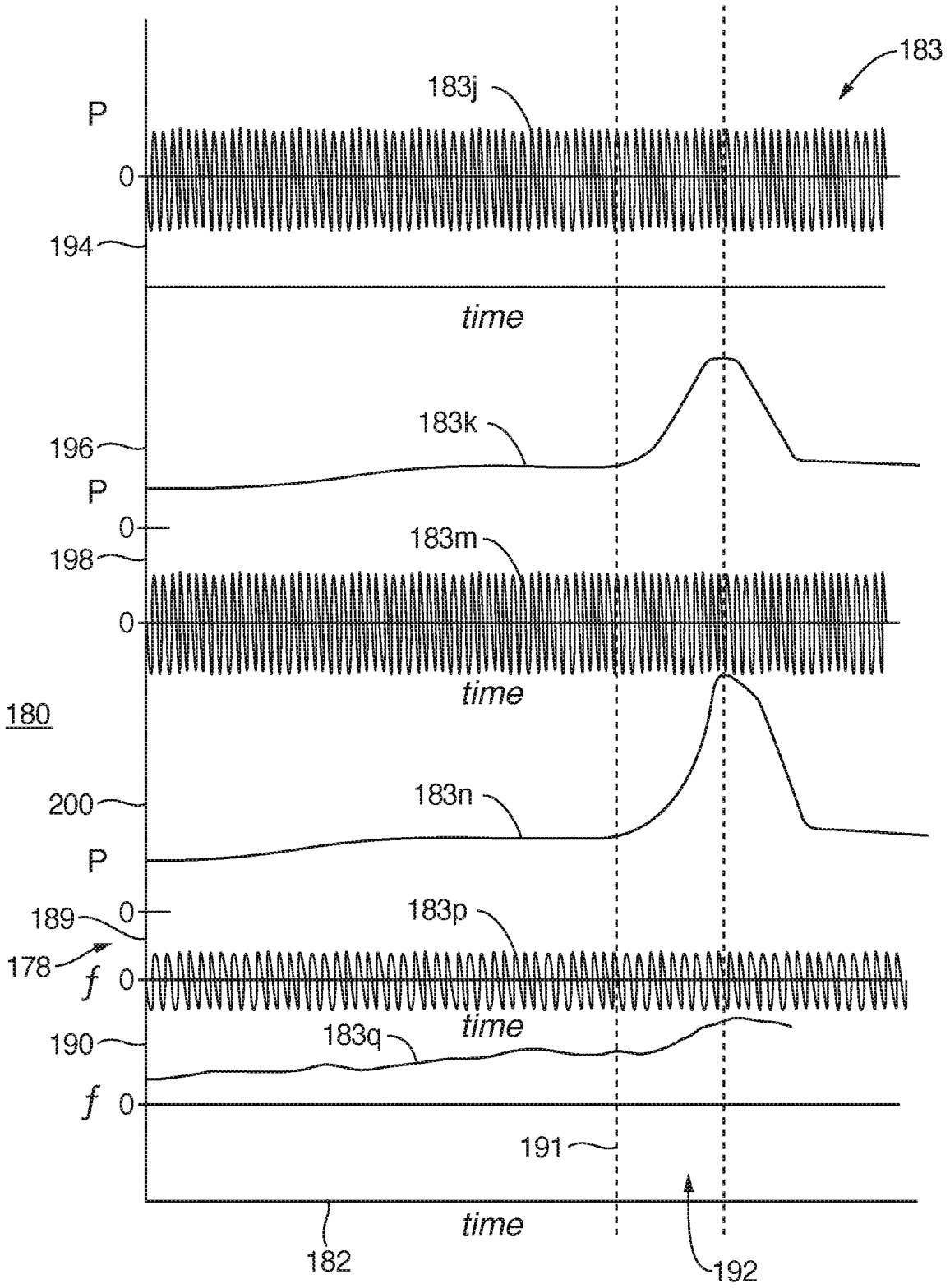
FIG. 12 is a chart as a function of time illustrating both raw and processed data streams (segmented as data strings) for internal drill string pressure, internal tool pressure, and frequency as they typically appear both as raw and processed data streams (and strings beginning with a header and ending with a trailer bounding the substantive data therein) to identify an event anomaly threatening to crowd and eventually crash a bit against a cutting face.

Referring to FIG. 12, pressure sensors 100*b*, 100*c* result in the curves 183*j*, 183*k*, 183*m*, 183*n*. Again, the raw pressure 194 is illustrated in curve 183*j*, while its average value 196 is reflected in the curve 183*k*. Again, the rapid variation due to the very mechanically noisy environment results in a nearly imperceptible representation of the anomaly 192 in the curve 183*j*. Nevertheless, once averaged, smoothed, or filtered, the curve 183*k* illustrates the anomaly 192 immediately upon its beginning at time 191.

Again, frequency 189 and the average frequency 190 or smooth frequency 190 are both detectable in the curves 183*p*, 183*q*. Likewise, the anomaly event 192 becomes evident in the smooth curve 183*q* extracted from the noisy curve 183*p*. The anomaly 192 represents a beginning or incipience of crowding by the suspended string 120 toward the BHA 50 and is now curable. Again, more relative distance between the moving elements 78, 80 of a CAS 70 provide more time, more certainty of detection, and higher probability of success in preventing any crash or even crowding of the bit 18 itself.

In certain embodiments, the processing hardware 110 may actually be responsible to filter, smooth, compare, or all of the above each of the measured parameters 184, 186, 188, 189, 190, 194, 196, 198, 200. Thus, for example, in certain embodiments, a detection by any sensor 180 of the anomaly 192 may be taken as a trigger 170 for halting the downward progress of the string 16. In a somewhat less cautious, but considered approach, each sensor 100 may contribute to an overall logical decision as to whether or not an anomaly 192 has occurred.

For example, certain of the parameters 184, 186, 188, 189, 190, 194, 196, 198, 200, may be evaluated to determine if more than one thereof has reported a value of a curve 183 indicating an anomaly 192. If all sensors 100 are reporting circumstances indicating the anomaly 192, then action is certainly required. If only one or two of the sensors 100 detect a condition indicating an anomaly 192, then it is possible or more likely that no actual anomaly 192 has occurred. Thus, certain confidence may be gained by the reliance on multiple sensors 100. Nevertheless, space availability may militate for more or fewer sensors 100 in a CAS 70 in accordance with the invention.

Figure 13:
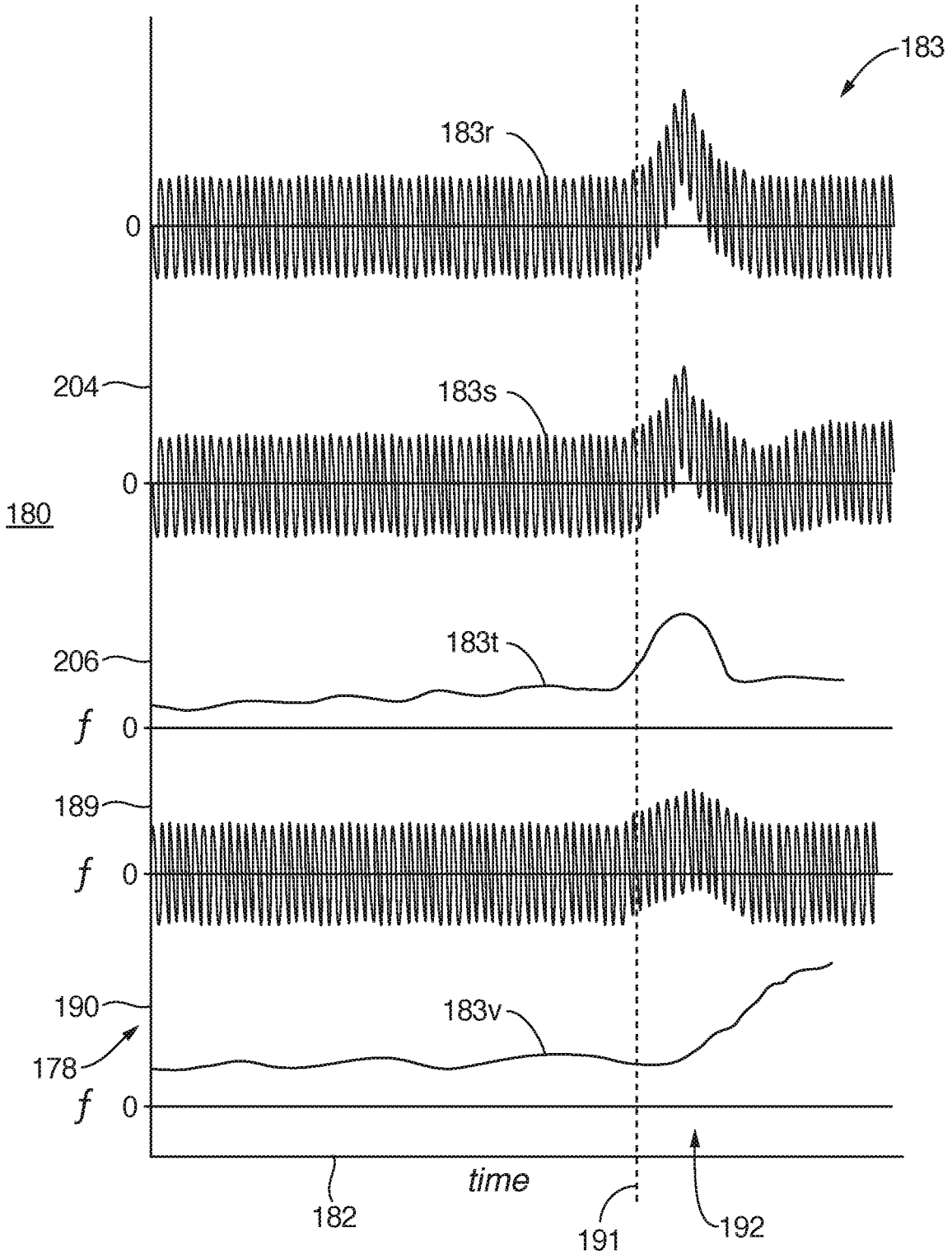
FIG. 13 is a chart illustrating as a function of time the typical appearance of a strain (reflecting stress) output and frequency thereof in both raw and processed formats, facilitating the appearance and detection of an event anomaly threatening to crowd or crash a bit against the cutting face.

Referring to FIG. 13, the curves 183*r*, 183*s*, 183*t*, 183*u*, 183*v* reveal the appearance of the data from strain gauges 100*e*. In the illustrated chart 180, the raw representation of strain 204 may be smoothed, averaged, or otherwise filtered to produce an average strain 206. Similarly, the rate of change, such as a zero crossing or a change in direction of the curve 183*r*, 183*s*, 183*t* basically defines a frequency 189 which may be represented as a smoothed frequency 190.

Strain is directly proportional to stress. The equation E (elastic modulus) equals sigma (stress) divided by epsilon (strain) is the governing relationship. Thus, stress, being a force per unit of area can represent a pressure, or a stress in a material. Thus, detection of strain 204, 206, is immediately proportional by a constant property (elastic modulus) of a material. Therefore, the stress is immediately detectable in any material properly equipped with strain gauges 100*e*.

Thus, the anomaly 192 is detectable as stress by virtue of its constant relationship with strain 204, 206. One difficulty with relying on stress or strain 204, 206 is that a solid material is being loaded in order to even cause strain. Thus, detection of position between movable elements 78, 80 of a CAS 70 may be preferable as an early warning that a suspended string 130 is evident faster than the bit0 18 can progress downward suddenly. Increased strain 204, 206 says the BHA 50 and bit 18 are already laboring. That may be too late to respond.

The present invention may be embodied in other specific forms without departing from its purposes, functions, structures, or operational characteristics. The described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

What is claimed and desired to be secured by United States Letters Patent is:

1. An apparatus as a crowding avoidance subassembly (CAS) capable of reconciling a speed of advancement (BSA) of a bottom hole assembly (BHA) downward with a speed of advancement (SSA) of a drill string downward, the apparatus comprising:

a housing capable of fitting above a drill bit in the bottom hole assembly of a drilling rig comprising the drill string defining an axial direction extending into a formation in the earth, the drill string being suspended by a lift system controlling descent of the drill string, and wherein the BHA comprises a bit driven into the formation by a weight of the BHA;

a base and a slide, capable of relative axial motion with respect to one another, fitted to the housing, the slide being fixed axially with respect to the string and electronically connected to pass data in an electronic format up the string toward the surface;

a sensor operably connected in the slide to send the data representing a parameter reflecting the relative axial motion to a computer controlling the lift system and programmed to reduce the SSA descent in response to the data in real time.

2. The apparatus of claim 1, wherein the data corresponds to the suspended drill string moving closer to the bit.

3. The apparatus of claim 2, wherein the sensor is positioned and capable of detecting one of acceleration, motion, velocity, position, pressure, frequency, and strain in the slide.

4. The apparatus of claim 3, wherein the parameter is a frequency of vibration.

5. The apparatus of claim 3, wherein the parameter is an integral with respect to time of a signal output by the sensor.

6. The apparatus of claim 1, wherein the sensor is a physical device providing an electrical signal based on variation of the parameter.

7. The apparatus of claim 1, wherein:

the parameter is a frequency of vibration within the range of human hearing; and the relative axial motion is a reduction of axial progression of the bit with respect to the suspended string.

8. A method comprising:

providing a crowding avoidance sub (CAS) operably connected to a bottom hole assembly (BHA) driven into a geologic formation by a drill string suspended by a lift and defining an axial direction, the lift controlling a string speed of advance (SSA) descending from a surface into the formation toward the BHA comprising a bit defining a cutting face in the formation;

the providing a CAS, wherein the CAS comprises a base and a slide, capable of relative motion axially with respect to one another, the slide operably connected to a sensor capable of detecting and passing data, reflecting the relative motion, in an electronic format up the string toward the surface;

descending the BHA, equipped with the CAS, downward into the formation at a first BHA speed of advance (BSA) corresponding to a rate of descent of the bit;

descending the drill string following the BHA at the first BSA;

reducing, by action of the formation against the bit, the BSA to less than the first BSA;

detecting, by the sensor, a parameter corresponding to the reducing;

sending from the sensor to a computer at the surface a signal reflecting the parameter; and controlling, by the computer, the SSA by reducing a rate of descent of the drill string, based on the signal.

9. The method of claim 8, wherein the controlling is in real time.

10. The method of claim 9, wherein the parameter represents the relative motion.

11. The method of claim 10, wherein the signal is data reflecting the drill string moving closer to the bit.

12. The method of claim 8, wherein the sensor is positioned and capable of detecting at least one of an acceleration, motion, velocity, position, pressure, frequency, and strain.

13. The method of claim 12, wherein the sensor detects a frequency of vibration.

14. The method of claim 8, wherein:

the parameter is an integral with respect to time of a signal output by the sensor;

the sensor is a physical device providing an electrical signal based on variation of the parameter;

the parameter is a frequency of vibration within the range of human hearing; and the relative axial motion corresponds to a reduction of axial progression of the bit with respect to the suspended string.

15. A method comprising:

providing a crowding avoidance subassembly (CAS) capable of fitting between a drill string, defining an axial direction and capable of descending into a bore in a formation, and a bottom hole assembly (BHA) under the drill string, the drill string being controlled by a lift at a surface of the formation, and the BHA comprising a bit driven by the BHA into the formation, wherein the CAS comprises a base and slide, capable of relative motion axially with respect to one another, and a sensor operably connected to detect, in the CAS, a condition of crowding between the BHA and the drill string, and to output data reflecting the condition, electronically up the string to a computer at the surface;

drilling, by the bit, into the formation at a first rate of descent reflecting a BHA speed of advance (BSA) downward;

following the BHA by the drill string at the first rate of descent;

sensing, by the sensor, a parameter reflecting the condition, corresponding to a reduction of the BSA to a second rate of descent, less than the first rate of descent, and reporting in real time by the sensor to a computer operably connected to control a string speed of advance (SSA) of the drill string by controlling the lift; and reducing the crowding condition between the drill string and the bit in the BHA, by the lift slowing the SSA to avoiding overrunning the BSA.

16. The method of claim 15, wherein:

the parameter reflects the relative axial motion; and the parameter is based on at least one of an acceleration, motion, velocity, position, pressure, frequency, and strain.

17. The method of claim 15, wherein:

the sensor is positioned to detect a frequency of vibration; and the signal is configured as data reflecting the suspended drill string moving closer to the bit.

18. The method of claim 15, wherein:

the parameter is an integral with respect to time of a signal output by the sensor;

the sensor is a physical device providing an electrical signal based on variation of the parameter.

19. The method of claim 15, wherein:

the parameter is a frequency of vibration within the range of human hearing; and the relative axial motion corresponds to a reduction of axial progression of the bit with respect to the suspended string.

20. The method of claim 15, comprising:

sensing, by the sensor the parameter;

pre-processing the parameter; and sending an emergency trigger to the computer reflecting a need to stop the drill string descending.

* * * * *